US008458974B2

(12) United States Patent
McIntosh et al.

(10) Patent No.: US 8,458,974 B2
(45) **Date of Patent: *Jun. 11, 2013**

(54) MEDALLION INSERT FOR MODULAR FLOORING ASSEMBLIES

(75) Inventors: Jonathan McIntosh, Omaha, NE (US); Craig Wyler, Papillion, NE (US); Timothy Seberger, Gretna, NE (US); Nicole Sperling, Roca, NE (US)

(73) Assignee: CoMc, LLC, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/526,679

(22) Filed: Jun. 19, 2012

(65) Prior Publication Data

US 2012/0260595 A1 Oct. 18, 2012

Related U.S. Application Data

(63) Continuation of application No. 12/792,774, filed on Jun. 3, 2010, now Pat. No. 8,230,654.

(60) Provisional application No. 61/185,961, filed on Jun. 10, 2009.

(51) Int. Cl.
*E04F 11/16* (2006.01)

(52) U.S. Cl.
USPC ..... 52/311.2; 52/177; 52/403.1

(58) Field of Classification Search
USPC ..... 52/311.2, 177, 180, 403.1, 460
See application file for complete search history.

(56) References Cited

U.S. PATENT DOCUMENTS

| | | | | |
|---|---|---|---|---|
| 527,961 | A * | 10/1894 | Furness | 52/590.1 |
| 2,303,745 | A | 12/1942 | Karreman | |
| 3,016,316 | A | 1/1962 | Olson | |
| 3,535,844 | A | 10/1970 | Glaros | |
| 3,553,921 | A | 1/1971 | Breistein | |
| 3,676,970 | A | 7/1972 | Edwards | |
| 3,723,233 | A | 3/1973 | Bourke | |
| 3,828,503 | A | 8/1974 | Hofmann | |
| 4,067,155 | A | 1/1978 | Ruff et al. | |
| 4,095,388 | A | 6/1978 | Breault | |
| 4,167,599 | A | 9/1979 | Nissinen | |
| 4,226,064 | A | 10/1980 | Kraayenhof | |

(Continued)

FOREIGN PATENT DOCUMENTS

| | | |
|---|---|---|
| DE | 2246778 B1 | 3/1974 |
| DE | 20009717 A1 | 12/2000 |

(Continued)

OTHER PUBLICATIONS

Basil Katcheves, USPTO "Office Action for U.S. Appl. No. 12/433,844", Feb. 2, 2010.

(Continued)

*Primary Examiner* — Basil Katcheves
(74) *Attorney, Agent, or Firm* — Edwin A. Sisson, Attorney at Law, LLC

(57) ABSTRACT

A tray substrate for a modular tile flooring system is disclosed that allows installation of medallion floating tiles into the flooring system. This tray substrate is designed to be a smaller medallion type tray substrate installed amongst larger tray substrates in a shape that is twisted at an angle to the grout lines of the other tiles. This is known as a medallion which is inserted in the layout.

13 Claims, 36 Drawing Sheets

U.S. PATENT DOCUMENTS

| | | | | |
|---|---|---|---|---|
| 4,287,693 | A | 9/1981 | Collette | |
| 4,453,365 | A | 6/1984 | Gladden | |
| 4,550,543 | A | 11/1985 | Valenzano | |
| 4,590,731 | A | 5/1986 | DeGooyer | |
| 4,640,850 | A | 2/1987 | Marocco | |
| 4,664,955 | A | 5/1987 | Clem | |
| 4,807,412 | A | 2/1989 | Frederiksen | |
| 4,840,825 | A | 6/1989 | Aristodimou | |
| 4,877,672 | A | 10/1989 | Shreiner | |
| 4,901,490 | A | 2/1990 | Zinniel et al. | |
| 4,917,532 | A | 4/1990 | Haberhauer et al. | |
| 4,930,279 | A | 6/1990 | Bart | |
| 4,931,331 | A | 6/1990 | Owens | |
| 5,052,158 | A | 10/1991 | D'Luzansky | |
| 5,103,614 | A | 4/1992 | Kawaguchi et al. | |
| 5,111,627 | A | 5/1992 | Brown | |
| 5,157,804 | A | 10/1992 | Williams | |
| 5,190,799 | A | 3/1993 | Ellingson, III | |
| 5,215,802 | A | 6/1993 | Kaars Sijpesteijn | |
| D347,722 | S | 6/1994 | Apps | |
| 5,386,670 | A | 2/1995 | Takeda et al. | |
| 5,418,036 | A | 5/1995 | Tokikawa et al. | |
| 5,616,389 | A | 4/1997 | Blatz | |
| 5,618,602 | A | 4/1997 | Nelson | |
| 5,678,369 | A | 10/1997 | Ishikawa et al. | |
| 5,678,380 | A | 10/1997 | Azzar | |
| 5,806,270 | A | 9/1998 | Solano | |
| 5,899,040 | A | 5/1999 | Cerrato | |
| 5,950,378 | A | 9/1999 | Council et al. | |
| 6,004,652 | A | 12/1999 | Clark | |
| 6,021,615 | A | 2/2000 | Brown | |
| 6,032,428 | A | 3/2000 | Rosan et al. | |
| 6,098,354 | A | 8/2000 | Skandis | |
| 6,127,015 | A | 10/2000 | Kessler | |
| 6,230,385 | B1 | 5/2001 | Nelson | |
| 6,247,286 | B1 | 6/2001 | Heyns | |
| 6,510,602 | B2 | 1/2003 | Sugiura | |
| 6,684,592 | B2 | 2/2004 | Martin | |
| 6,694,689 | B1 | 2/2004 | Scott et al. | |
| 6,802,159 | B1 | 10/2004 | Kotler | |
| 7,197,855 | B2 * | 4/2007 | Della Pepa | 52/460 |
| 2002/0189176 | A1 | 12/2002 | Stegner et al. | |
| 2002/0189182 | A1 | 12/2002 | Record | |
| 2003/0074855 | A1 | 4/2003 | Nelson | |
| 2003/0097808 | A1 | 5/2003 | Sabatini | |
| 2003/0154676 | A1 | 8/2003 | Schwartz | |
| 2003/0233809 | A1 | 12/2003 | Pervan | |
| 2004/0074190 | A1 | 4/2004 | Lin et al. | |
| 2004/0139679 | A1 | 7/2004 | Della Pepa | |
| 2004/0187423 | A1 | 9/2004 | Weber | |
| 2004/0226242 | A1 | 11/2004 | Moller, Jr. | |
| 2005/0034395 | A1 | 2/2005 | Kotler | |
| 2005/0039413 | A1 | 2/2005 | Schrotenboer | |
| 2005/0144867 | A1 | 7/2005 | Clarke | |
| 2005/0144879 | A1 | 7/2005 | Fiorino | |
| 2005/0200062 | A1 | 9/2005 | Maurer et al. | |
| 2005/0208255 | A1 | 9/2005 | Pervan | |
| 2006/0230701 | A1 | 10/2006 | Pepa | |
| 2007/0094969 | A1 | 5/2007 | McIntosh et al. | |
| 2007/0094979 | A1 | 5/2007 | Richardson et al. | |
| 2007/0227090 | A1 | 10/2007 | Plante | |
| 2008/0078135 | A1 | 4/2008 | McIntosh et al. | |
| 2008/0173569 | A1 | 7/2008 | Forsyth | |

FOREIGN PATENT DOCUMENTS

| | | | |
|---|---|---|---|
| DE | 19962812 | A1 | 6/2001 |
| DE | 20205774 | U1 | 4/2002 |
| DE | 202004017921 | U1 | 1/2005 |
| DE | 102006021426 | A1 | 11/2007 |
| EP | 0176645 | B1 | 10/1984 |
| EP | 0256189 | B1 | 2/1988 |
| EP | 0544604 | B1 | 2/1993 |
| EP | 1039057 | A1 | 9/2000 |
| EP | 1146182 | A1 | 10/2009 |
| GB | 1350754 | A1 | 4/1970 |
| GB | 2216976 | A | 10/1989 |
| GB | 2284846 | A | 6/1995 |
| GB | 2307489 | A | 5/1997 |
| WO | 0008274 | A1 | 2/2000 |
| WO | 0175247 | A1 | 10/2001 |
| WO | 02101175 | A1 | 12/2002 |
| WO | 03040491 | A1 | 5/2003 |
| WO | 2004070134 | A1 | 8/2004 |
| WO | 2004081316 | A1 | 9/2004 |
| WO | 2005098164 | A1 | 10/2005 |
| WO | 2009055852 | A1 | 5/2009 |

OTHER PUBLICATIONS

Edwin A. Sisson, "Response to Office Action for U.S. Appl. No. 12/433,844, Issued Feb. 2, 2010", Jul. 28, 2010.

James Ference, USPTO "Office Action for U.S. Appl. No. 11/839,443", Jul. 21, 2010.

James Ference, USPTO "Office Action for U.S. Appl. No. 11/839,443", Mar. 30, 2010.

Edwin A. Sisson, "Response to Office Action for U.S. Appl. No. 11/839,443, Issued Mar. 30, 2010", May 17, 2010.

James Ference, USPTO "Office Action for U.S. Appl. No. 11/839,443", Sep. 3, 2009.

Edwin A. Sisson, "Response to Office Action for U.S. Appl. No. 11/839,443, Issued Sep. 3, 2009", Nov. 25, 2009.

Basil Katcheves, USPTO "Office Action for U.S. Appl. No. 11/432,873", Sep. 19, 2008.

Basil Katcheves, USPTO "Office Action for U.S. Appl. No. 11/432,873", Jan. 16, 2008.

Glen H. Lenzen, Jr., "Amendment and Response to Office Action for U.S. Appl. No. 11/432,873, Issued Jan. 16, 2008", Jun. 16, 2008.

Yvonne Horton, USPTO "Office Action for U.S. Appl. No. 11/432,873", Mar. 22, 2007.

Glen H. Lenzen, Jr., "Amendment and Response to Office Action for U.S. Appl. No. 11/432,873, Issued Mar. 22, 2007", Jun. 22, 2007.

Edwin A. Sisson, "Response to Office Action for U.S. Appl. No. 11/839,443, Issued Jul. 21, 2010", Nov. 22, 2010.

Edwin A. Sisson, "Response to Office Action for U.S. Appl. No. 11/432,873, Issued Sep. 19, 2008", Nov. 26, 2008.

Edwin A. Sisson, "Amendment and Response to Office Action for U.S. Appl. No. 12/433,844, Issued Oct. 12, 2010", Dec. 4, 2010.

Basil Katcheves, USPTO "Office Action for U.S. Appl. No. 12/433,844", Oct. 12, 2010.

Joshua Ihezie, USPTO "Office Action for U.S. Appl. No. 11/137,705", Sep. 17, 2008.

Christopher A. Eusebi, "Response to Office Action for U.S. Appl. No. 11/137,705, Issued Sep. 17, 2008", Dec. 17, 2008.

Joshua Ihezie, USPTO "Office Action for U.S. Appl. No. 11/137,705", Feb. 17, 2009.

Edwin A. Sisson, "Response to Office Action for U.S. Appl. No. 11/137,705, Issued Feb. 17, 2009", May 15, 2009.

Basil Katcheves, USPTO "Advisory Action for U.S. Appl. No. 12/433,844", Dec. 16, 2010.

James Ference, USPTO "Final Office Action for U.S. Appl. No. 11/839,443", Jan. 7, 2011.

* cited by examiner

MEDALLION INSERT FOR MODULAR FLOORING ASSEMBLIES

PRIORITY AND CROSS REFERENCES

This Application is a continuation of U.S. patent application Ser. No. 12/792,774 filed 3 Jun. 2010 which is the non-provisional application from, and claims the benefit and the priority of, U.S. Provisional Patent Application Ser. No. 61/185,961 filed 10 Jun. 2009.

FIELD OF INVENTION

The present invention relates to a modular flooring assembly including a flooring component adhered to a tray substrate that can be part of a larger flooring assembly.

BACKGROUND OF INVENTION

United States Patent Publication 2007009469 teaches the use of a tray substrate and a flooring component to create a floating tile structure. The trays interlock with each other as demonstrated in FIG. 17 of that specification. U.S. Pat. No. 7,197,855 teaches the use of a tray substrate and a flooring component interlocked as well.

Both of these systems require that flooring components are laid in substantially the same direction and trueness. For example, the edges of the square of one substrate would interlock at the edges of the square of the other tray substrate. Neither of these systems provide any guidance on placing a specially shape tile, known as a medallion, in the middle of the interlocking pattern.

SUMMARY OF THE INVENTION

This application is to a component of a flooring system comprising a tray substrate comprising a tray substrate surface which is an upward facing horizontal surface having a tray substrate surface perimeter, a tray substrate bottom with a padding attached to the tray substrate bottom, a plurality of tray substrate vertical tray edges which protrude upward and extend along the tray substrate surface perimeter, a plurality of tray substrate edges defining an outside perimeter of the tray substrate, the tray substrate edges having a plurality of radial arms; each radial arm extending horizontally in a radial direction from a geometric center of the radial arms; with each radial arm having at least one adjacent radial arm and each radial arm and the adjacent radial arm are separated by a radial angle.

It is further disclosed that the tray substrate have a at least one stop and that the stop may continuously between one radial arm and at least one adjacent radial arm. It is also disclosed that the tray substrate have a flooring component adhered to the tray surface and that the flooring component can be selected from the group consisting of tile, stone, marble, wood, ceramic tile, porcelain tile, glass and granite.

It is also further disclosed that the tray may have a plurality of tray substrate vertical tray edges which protrude upward and extend along the tray substrate surface perimeter, and said vertical tray edges may optionally run the entire perimeter of the tray substrate surface.

It is further disclosed that the radial angles between each radial arm and the adjacent radial arm are approximately the same. It is also further disclosed that the component may have at least two stops located on the outside perimeter between at least one radial arm and at least one adjacent radial arm adjacent to the at least one radial arm.

The fact that at least one stop may have a stabilizer tab is also disclosed. It also disclosed that the tray substrate surface may have a plurality of vertical setting pins protruding up from the tray substrate surface that will be used to hold a flooring component in place on the tray substrate.

DETAILED DESCRIPTION

Figure 1:
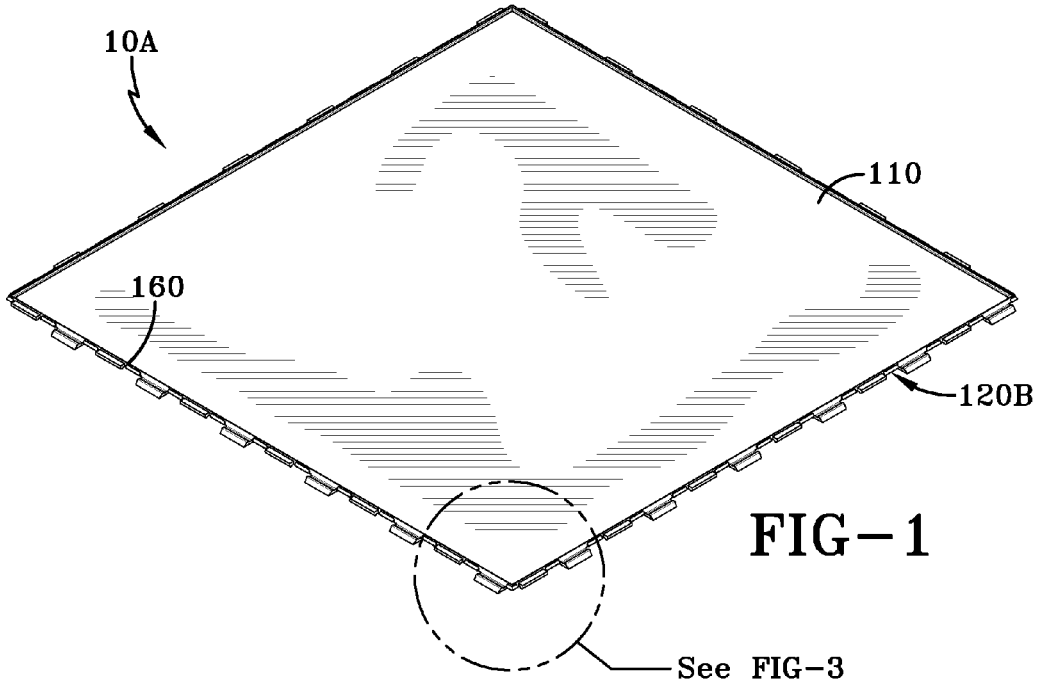
FIG. 1 shows a perspective view of the master tray substrate.

The present invention relates to a modular flooring assembly including a flooring component adhered to a master tray substrate aligned with a medallion tray substrate. The modular flooring assembly may be interconnected with additional modular flooring assemblies to form a modular floor suitable for most flooring applications. The flooring components of the master modular flooring assembly and the medallion modular flooring assembly may comprise tile or wood or other materials commonly used in flooring applications.

The master tray substrate may comprise tabs, which provide for the master tray substrates to interlock with tabs from an adjacent master tray substrate.

The medallion tray substrate usually does not have interlocking tabs, but has radial arms that fit between the gap between the adjacent interlocked master tray substrates. This gap is also known as the grout line. The fully assembled modular floor provides the appearance of a conventional floor. Fill-in grout or a snap-in grout may be used with the modular flooring assemblies. Suitable types of grout are acrylic, urethane, epoxy and latex modified.

One suitable snap-in grout is a right angle grout member. The right angle snap-in grout member may comprise inserts that are received by grout slots formed between the tabs of the master tray substrate. Optional grout panels on the perimeter of the master and medallion tray substrates may also be used in receiving the snap-in or fill in grout. The grout panels are on the perimeter of the tray substrate which includes a plurality of the grout panels. The grout panels on the master tray substrate are located between the alternating upwards tabs and the downward tabs.

The grout panels on the medallion tray substrate are located on the side and optionally the radial arms. The grout panels generally have an angled shape that widens towards the bottom of tray substrate. This provides an undercut for the grout to secure the tray substrate from vertical movement that otherwise would only be restricted by the adhesion of the fill in grout to the side wall of the tray substrate.

The master and medallion tray substrates hold the flooring component on their respective tray surface. The tray surface is an upward facing horizontal surface with optional vertical tray edges which protrude upward from the horizontal tray surface and outline the perimeter of the tray surface.

The tray surfaces of both the master and medallion tray substrates may be generally flat, or may contain a pattern designed to enhance adhesive performance between the tray surface and the flooring component. The tray surface pattern may be designed to complement the bottom of the flooring component; for example, tiles may have different mold patterns on their bottom depending upon the manufacturer's design. The tray surface may also be solid, or may have holes therein. The holes may be added in appropriate locations to aid in moisture evaporation without compromising adhesive performance.

The optional vertical tray edges of the master tray substrate and medallion tray substrate can be preferably designed to ensure exact alignment of the flooring component with the tray surface. The vertical tray edges do not have to run the entire perimeter of the tray substrate, but preferably should run the entire perimeter of the tray substrate. In most embodiments, the inside of the vertical tray edges define an area smaller than the area defined by the perimeter of the tray substrate. The flooring component is positioned within the vertical tray edges and is adhered to the tray surface which in some embodiments is defined by the inside wall of the vertical tray edges.

In some embodiments, the optional vertical tray edges do not surround or define the shape of the flooring component. For example, a round flooring component can be held by three small vertical tray edges. A triangle could also be held by three vertical tray edges, as well as an irregular shaped flooring component such as a logo. In any case, there is a minimum number of edges necessary to hold the component in place.

In one embodiment of the medallion tray substrate, the optional vertical tray edges will form, or trace, the outer shape of the medallion flooring component and will hold the flooring component of the particular design. This design could be the traditional square, oval, circle, or triangle. The design could also be arbitrary such as the shape of an animal, a statue, a building, or even the outline of a state, such as the state of Texas, United States of America, or the state of Alaska, United States of America. The flooring component of the medallion tray substrate could also be in the shape of a company logo, a coat of arms, a family crest, or some other irregular shape.

In another embodiment, the vertical tray edges do not trace the shape of the of the medallion and are sufficient in number, usually three or four, to immobilize the medallion from shifting on the tray surface.

By their vertical orientation relative to the tray surface, the vertical tray edges positionally hold the flooring component and, in combination with the adhesive, reduce lateral movement. The vertical tray edges may provide a further surface for the adhesive to adhere the side of the flooring component. The tray surface joins to the bottom of the flooring component via the adhesive and the tray edges join to the sides of the flooring component via the adhesive. The combination of the adhesive on the tray surface and the adhesive on the tray edges securely hold the flooring component. This insures that the flooring component is locked down to the tray substrate, and the flooring component does not slip or move.

In one embodiment, the size of the tray substrate and the flooring component are strictly controlled to insure that the flooring component is smaller that the area defined by the vertical tray edges and fits securely in the tray substrate. The flooring component should just fit onto the tray surface and rest snugly against the vertical tray edges. In one embodiment, the flooring component is slightly smaller than the tray surface defined by the vertical tray edges.

In another embodiment or part of any embodiment, there may be optional vertical setting pins which protrude upward from the tray surface. The height of these vertical setting tabs from the tray substrate surface will be less than the thickness of the flooring component, preferably less than three quarters of the thickness of the flooring component. These vertical setting tabs may be a pin, square, rectangle or other shape of various thicknesses and lengths relative to the height. These vertical setting pins would fit into a cut, hole, slot or other opening, called a setting hole, in the bottom of the flooring component and would serve to position the flooring component like the vertical tray edges. In this manner one tray substrate may be used for a multitude of flooring components. The vertical setting pin mates with the setting hole of the flooring component. With the use of multiple setting tabs and setting holes of different sizes, the orientation of the flooring component on the relative to the radial arms can be uniquely established. For example, one vertical setting pin and its corresponding setting hole could be square, the other vertical setting pin and the other setting hole could be rectangular guaranteeing alignment of the medallion relative to the radial arms.

Another embodiment uses a plurality of vertical setting pins instead of the vertical tray edges. Some of the pins can be removed and the pins remaining form a sufficient outline for the flooring component medallion to remain aligned in the proper position. This is shown in FIGS. 40-44.

There are often tabs on the outside perimeter of the master tray substrate. The tabs interlockingly connect the master tray substrates. In one embodiment of the master tray substrate, there are upward and downward facing tabs. The upward and downward tabs may or may not alternate on each edge of the tray substrate. For most flooring applications, the use of 6, 8, or 10 tabs per edge, half of each orientation, provide satisfactory performance. In other embodiments, there may be fewer or additional tabs. The tabs do not necessarily have to alternate. In practice, it has been found that the number of tabs be in multiples of four.

The interlocking tabs may be positioned such that the modular flooring assemblies are offset supporting various decorative patterns.

The interlocking tabs on one modular flooring assembly need not be perfectly aligned with the other modular flooring assembly to allow "fine-tuning" of the relative tile position.

The bottom of the master and medallion tray, i.e., opposite of the tray surface, is designed as the foundation of the system. The bottom may include structural webbing to strengthen the tray bottom ensuring the tray surface remains relatively flat.

The bottom of the tray may also include an optional non-skid and noise deadening padding of an over-molded, rubber-like material, such as thermoplastic rubber or thermoplastic elastomer. A particularly preferred thermoplastic elastomer is SANTOPRENE®. The padding provides a cushion for the flooring system. The padding also provides a non-skid element that prevents the flooring system from sliding on the underlying flooring material. The padding also provides some level of flex in the presence of underlying floor surface imperfections or heavy surface loads. The padding also helps reduce vibration transmission, thus providing a sound-deadening function.

As described above, various types of grout may be used in the present invention, including the snap-in grout or a fill-in grout compound that is spread into the gaps between neighboring trays.

The snap-in grout includes a snap-in locking mechanism. The snap-in grout is preferably made from thermoplastic elastomer, thermoplastic rubber, or other compressible, pliable, sealing material designed to fit between the tray substrates and provide a dust and moisture barrier.

In some embodiments, the grout fits into slots created by the interlocking tabs. Grout panels on the perimeter of the tray substrate may also be used in receiving the grout and in forming the slots.

In other embodiments, the grout fits into or fills the grout holes formed in the interlocking tabs. Both the upward and downward tabs may have grout holes. When the tabs are interconnected, the grout holes overlap and provide a combined grout hole to receive the snap-in grout. The grout hole is generally positioned in the middle area of each tab and is designed to accommodate the snap-in grout line. When the upward and downward tabs are aligned, the grout component fits through the hole.

Fill-in grouts may also be used with the trays. Fill-in grouts may be packaged in a powdered or granular form. The user mixes the powder or granules with a liquid to form a plastic material that is spread in between the modular flooring assemblies. Other fill-in grout compounds are packaged in a ready to spread form. The modular flooring assemblies are snapped together and the fill-in grout material is used to fill the space between the modular flooring assembly. The fill-in grout material should remain semi-flexible once cured since the floor "floats" because it is not fixed to the floor. The separate grout material should also have good adhesive qualities to ensure the material adheres to the sides of the modular flooring assemblies.

The flooring components, including the medallion flooring component, may comprise tile, stone, marble, wood, or other conventional flooring materials like engineered stone, sand stone, exotic stone, glass or even metal. The flooring components could be a ceramic or porcelain tile, a natural stone product like marble or granite, or could be a wooden product.

The master or medallion flooring component is preferably adhered to the master or medallion tray surface and tray edges using any of a variety of commercially available adhesives. Suitable adhesives for use with the present invention include a two-part epoxy using a methacrylate material, silicone, rubber based and urethane. The specific selection of the adhesive will depend on the nature and properties of the flooring component. The methacrylate adhesive is preferred for ceramic tile.

The tray may be made using injection molding of a suitable plastic resin. Medium impact polystyrene is preferred, but other plastic resins including polypropylene, high impact polystyrene and ABS may be used.

The padding of the non-skid and noise deadening material may be a thermoplastic rubber, thermoplastic elastomer, or other softer plastic material including SANTOPRENE®. The padding is over-molded to the base of the tray. An adhesive is applied between the tray surface and the bottom of the flooring surface.

Multiple adhesive materials and application patterns can be used depending upon the combination of plastic resin used for the tray, the flooring material, and the profile of the flooring material. For tile application, adhesive is applied to the ridgelines on the bottom of the tile to maximize contact with the tray surface.

The modular flooring assemblies of the present invention may be used in any size embodiments. The modular flooring assemblies of the master tray substrate are usually a square or rectangular shape. The square shaped modular flooring assemblies have four sides of equal length. Other sizes may be used, however these sizes are generally used in the flooring industry. Further, a combination of the 6-inch and 12-inch modular flooring assemblies may be used in combination to provide a unique appearance. The present invention may be further modified to include other combinations of different sized modular flooring assemblies.

During assembly of the present invention, the modular flooring assemblies are snapped together to form an overall flooring surface. The fill-in grout material may be applied between the modular flooring assemblies, or the snap-in grout may be installed. In order to accommodate different rooms of varying sized and shapes, the modular flooring assemblies can be cut using a wet saw if tile or stone is the flooring component or using a table or a circular saw for wooden flooring components.

The underlying flooring surface should be free of major surface variations, but need not be in perfect condition. No special floor preparation is required to ensure the tiles are fixed since the interlocking modular flooring assemblies will "float" and flex. The system can be installed directly on top of finished wood, linoleum, other tile, concrete, plywood, or a variety of other flooring systems. The modular flooring assemblies can be installed on top of padding or other underlayment material if an additional measure of insulation or padding is desired. The modular flooring assemblies can be installed on top of radiant-type heating systems as well.

Many times a person wishes to put a design in the tile floor. One common design is to cut away the same size isoceles triangle from each of four interconnected master flooring assemblies at the point of their alignment. This leaves a square opening rotated 45 degrees from the master tray substrate. In a conventional tile system, a smaller medallion tile would be set into the opening with a corner of the medallion tile laying in the grout line between two master tiles. The medallion tray substrate provides a unique way of placing a medallion tile into the modular interlocked master tile assemblies.

As described earlier, the medallion tray substrate is similar to the master tray substrate in many ways. The medallion tray substrate has optional vertical tray edges, a tray surface, a tray bottom, an optional pad. It may also have optional vertical setting pins. The medallion tray substrate differs from the master tray substrate in that the medallion tray substrate does not have interlocking connections configured like the master tray substrate.

The medallion tray substrate has at least two radial arms that protrude from the tray side in the radial direction measured from the geometric center of the radial arms. The geometric center of the radial arms is the point from which the arms radiate and the point around which the angles separating the radial arms are measured. The geometric center of the radial arms may be the geometric center of the medallion tray substrate, but it does not have to be. For example, if one wished to offset the medallion design from the grout lines of the master tray substrate, one would place the geometric center of the radial arms well away from the geometric center of the medallion tray substrate.

The radial arm is designed to slide in between the grout line of two interconnected master tray substrates.

In addition to the radial arms, the medallion tray substrate has a plurality of stops. The stop is designed so that a relatively constant gap is maintained between the master tray assembly and the design of the medallion. In one embodiment the stop is part of the radial arm and forms the base of the radial arm. In another embodiment the stop runs the entire perimeter of the outer edge of the tray and between the radial arm. In yet another embodiment, there are at least two stops between two adjacent radial arms with at least one stop between the first radial arm and midpoint to the second radial arm and the other stop located between midpoint between the two arms and the second radial arm. This would prevent the medallion from rocking about a single stop as a pivot point.

All or one of the stops may also have a stabilizer tab which protrudes horizontally from the stop and is aligned with the bottom of the medallion tray substrate. The length of the stabilizer tab in the horizontal direction is not so important, but it should be at least long enough to slide under a master tray substrate. The horizonalty length therefore is at least the thickness of the designed grout line, which is typically in 1.5875 mm (0.0625 or $1/16^{th}$ inch) increments. Therefore the horizontal length is preferably at least 1.5875 mm measured from the stop, more preferably at least 3.175 mm measured from the stop, and yet more preferably at least 6.35 mm measured from the stop.

The stabilizer tab is designed to slide between the floor and master tray substrate. Therefore the thickness of the stabilizer tab in the vertical direction is such that it could easily slide underneath the master tray substrate. Preferably, the stabilizer tab would slide into the gap between the master tray substrate and the floor.

The width of the stabilizer tab is not so important either. One skilled in the art will be easily able to determine width which can slide under the master tray substrate. The stabilizer could also be molded in a shape to mate directly with the gap under the master tray substrate.

The outer edge of the stop can run parallel to, or otherwise trace or follow, the line traced by the optional vertical tray edges. In the case of a non-straight edge, such as a circular medallion, a zig-zag, or arbitrary trace, the radial distance from outermost point of the stop to the geometric center of the radial arms should be the same for at least two of the stops that might be located between two adjacent radial arms. Again, the stop may be a continuous strip running around the outside of the tray between two adjacent radial arms.

In some embodiments, the radial arm may optionally have a key which is a ridge and a key end running across the top of the radial arm. Depending up the style of master tray substrate and the cut made across the master tray substrate, the radial arm can be designed to line right up to the edge of the grout panels of the master tray substrate. In this manner, the stop prevents the medallion from coming too close, while the key end mated with the grout member keeps the arm from coming out.

The number of radial arms is determined by the placement of the medallion in the assembled master tray substrates. Two (2) radial arms are preferred when placing the medallion between two assembled master tray substrates along their grout line. Three radial arms are preferred if the medallion tray substrate is to be placed at the "tee" intersection of three assembled master tray substrates. Four radial arms are preferred if the medallion is to be placed at the intersection of four assembled master tray substrates.

The present invention will now be described with reference to the Figures:

The master tray substrate and components making up the master modular floor assembly is shown FIGS. 1-4. A master tray substrate 10A is shown in FIG. 1. The master tray substrate 10A includes a horizontal tray surface 110 with a vertical tray edge 160 and tray bottom 120A.

Figure 2:
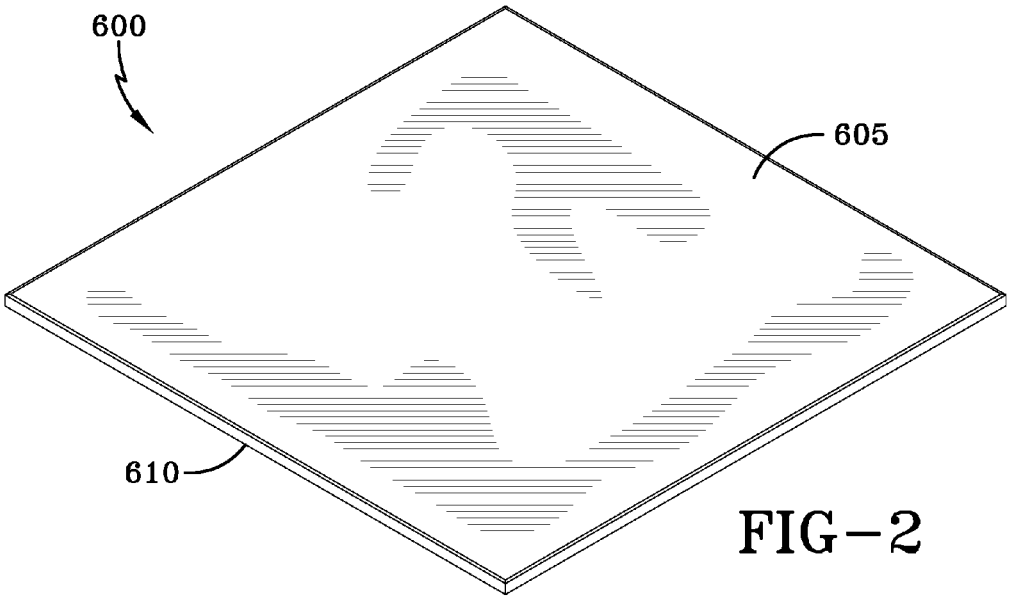
FIG. 2 shows a view of the flooring component.

FIG. 2 shows the flooring component 600. A top surface 605 of the flooring component 600 forms the floor surface. A bottom surface 610 of the flooring component 600 is adhered to the tray surface 110 by an adhesive. Although in this embodiment the flooring component 600 is a ceramic tile, the flooring component may be made from any conventional flooring material. Additionally, unless specifically noted, the flooring component material could be used in either the master tray substrate or the medallion tray substrate.

The raised edges 160 are preferably shorter than the height of the flooring component 600. Preferably the raised edges 160 completely surround the flooring component 600.

Figure 3:
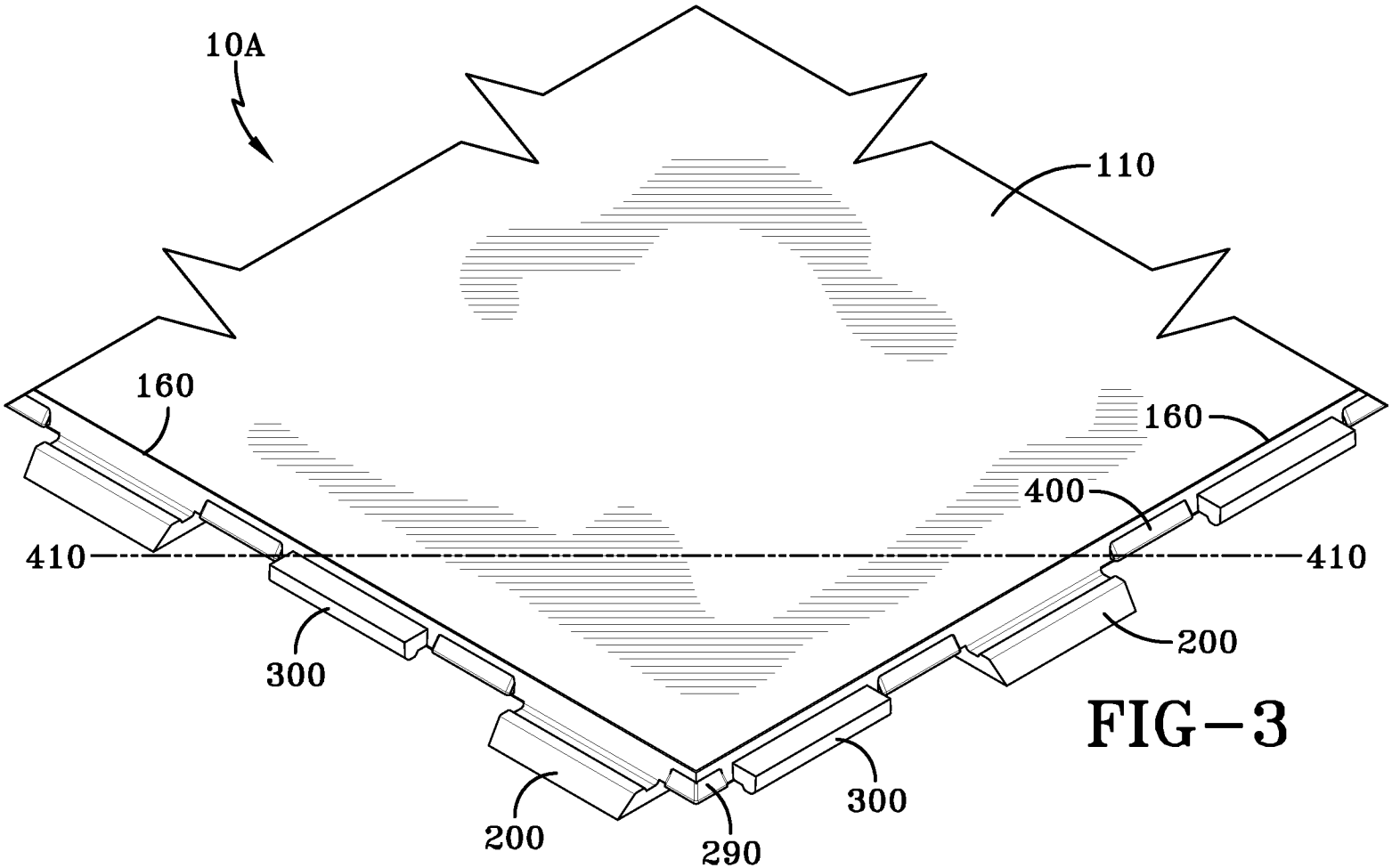
FIG. 3 shows a perspective, partial view of the master tray substrate.

FIG. 3 is a cutaway of the circled portion of the master tray substrate 10A in FIG. 1. The cutaway shows the vertical tray edges 160, the horizontal tray surface 110. A perimeter of the tray 10A provided with a plurality of upward tabs 200 and a plurality of downward tabs 300. The upward tabs 200 interact with downward tabs 300, and the downward tabs 300 interact with the upward tabs 200 on an adjacent master tray substrate 10A. This provides the interconnection between adjacent master tray substrates 10A. Also shown is a corner grout panel, 290. Also depicted is line 410 which is the portion of the master tray substrate or master flooring module which will be cut so that the medallion tray substrate may align with it. 400 depicts grout panels which may be also used to hold the medallion tray substrate in place as described in FIGS. 26-30.

In this embodiment, the tray 10A is provided with a total of 6 upward tabs 200 and 6 downward tabs 300 per side of the master tray substrate 10A. The tray 10A is designed to form a 12-inch flooring assembly, and more or less tabs may be utilized in larger master tray substrates 10A and smaller master tray substrates 10A.

Figure 4:
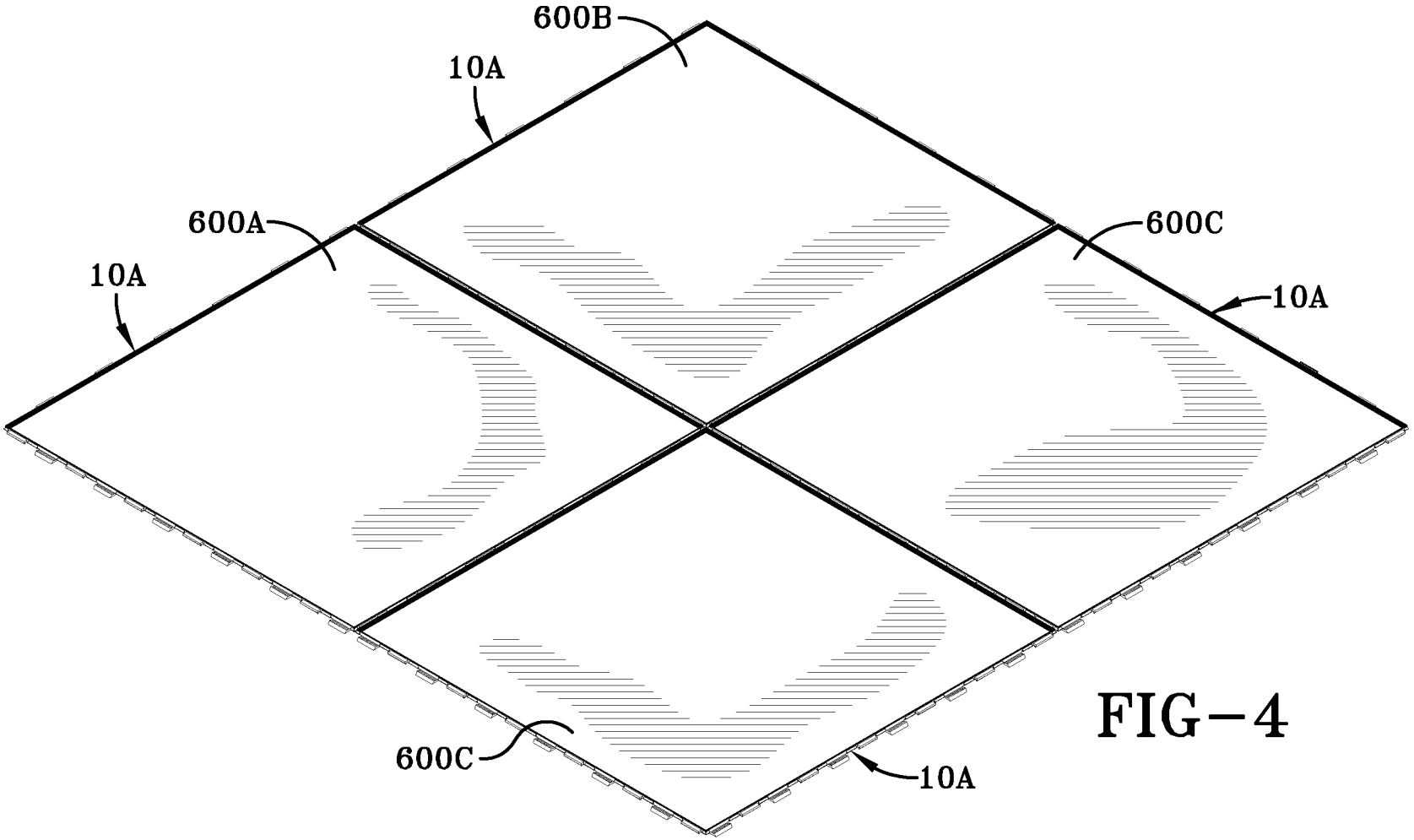
FIG. 4 shows a perspective of four master modular flooring assemblies in their assembled perspective.

FIG. 4 shows four master modular flooring assemblies comprised of master tray substrates labeled 10A, 10B, 10C, 10D, with flooring components 600A, 600B, 600C, and 600D adhered to the respective master tray, in the assembled interlocked fashion.

Figure 5:
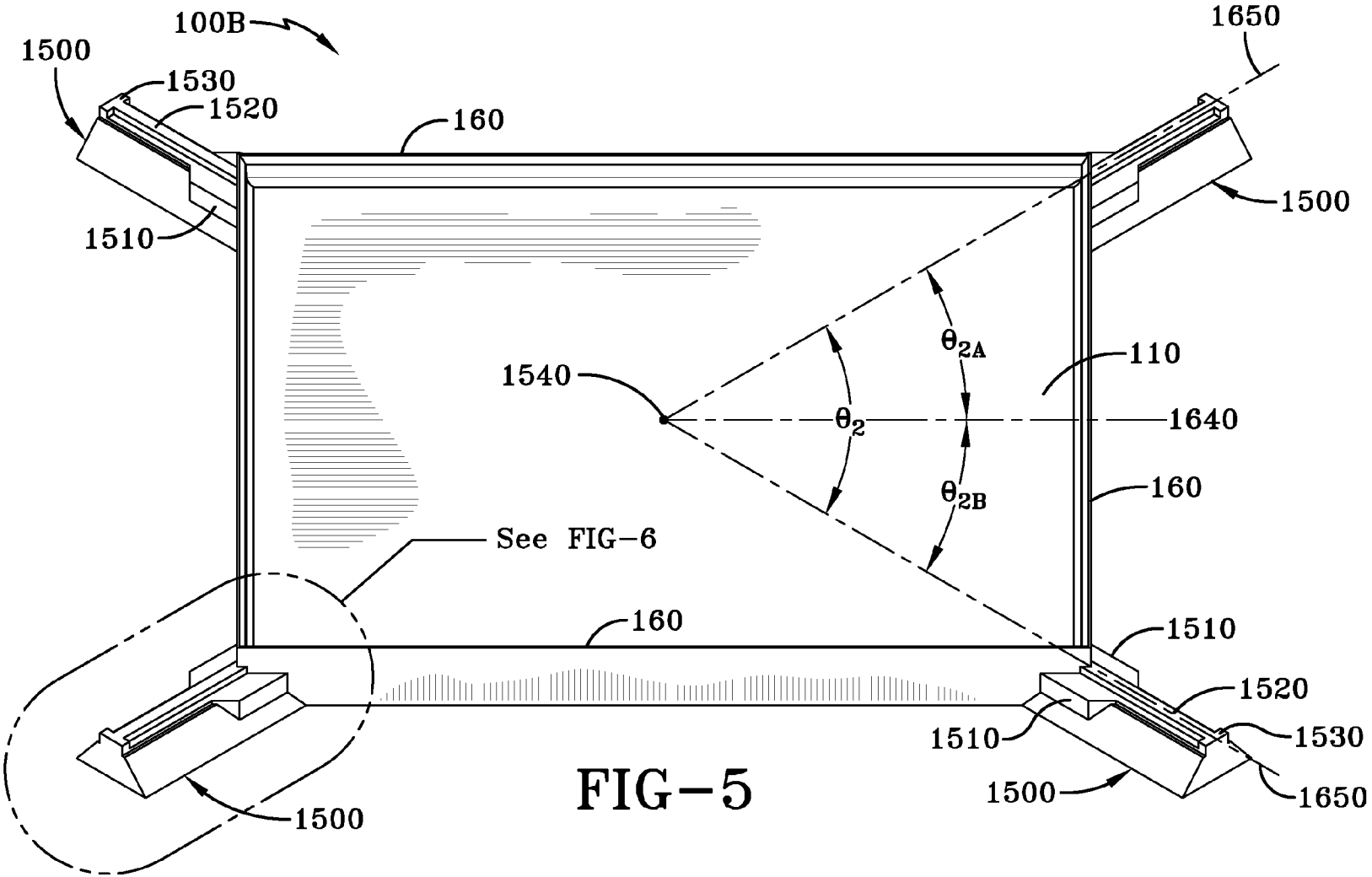
FIG. 5 shows a perspective view of the medallion tray substrate.
Figure 9:
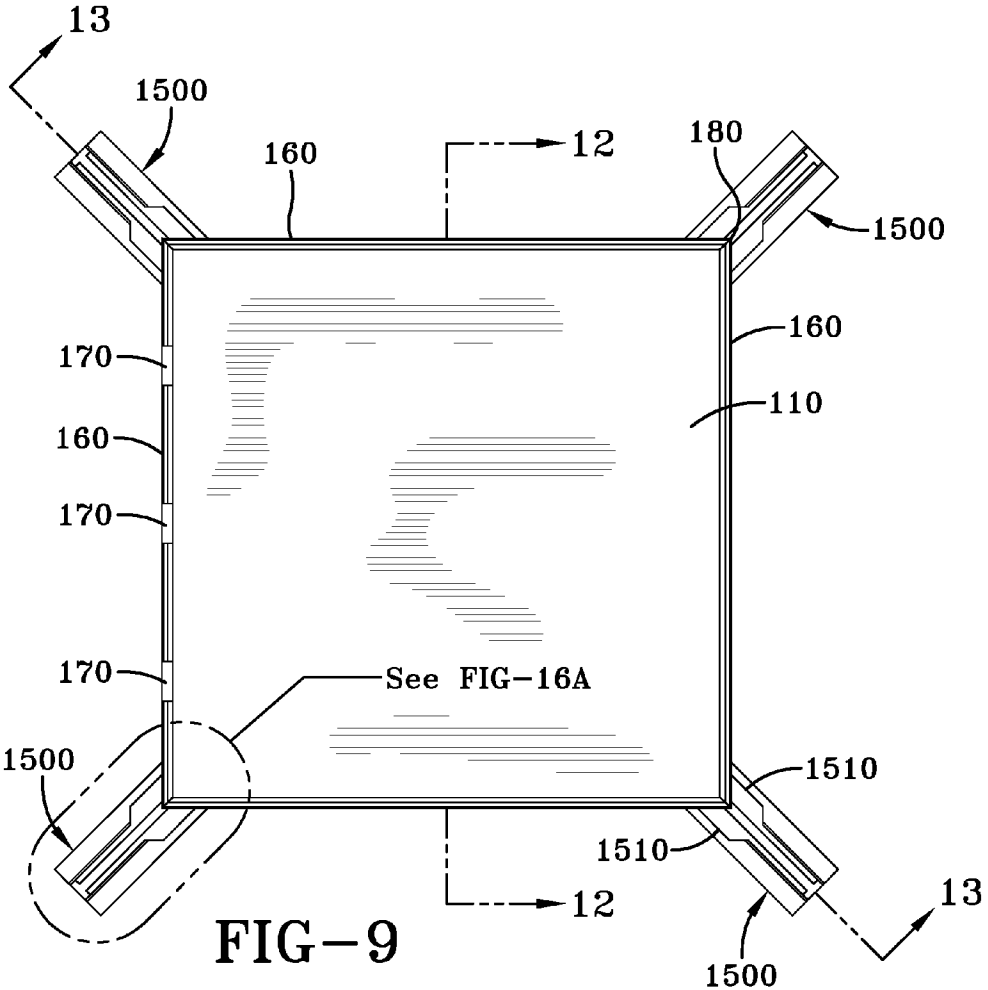
FIG. 9 shows a view of an alternate embodiment.

FIG. 5 is a perspective view of the medallion tray substrate. Like the master tray substrate the medallion tray substrate has a horizontal surface 110, vertical tray edges 160, which preferably run the perimeter of the tray surface, but do not have to as shown in FIG. 9, 170. The medallion tray substrate has radial arms 1500 that radiate from a geometric center of the radial arms 1540 extending horizontally from the side of the tray substrate. There will be an angle $\theta_2$, which is the angle between two adjacent radial arms. While it is preferred that the angle between all the radial arms and the adjacent arms be the same, there are some circumstances such as a triangular insert which this may not be required. The angle between the radial arm and the adjacent arm can be bisected into two equal angles, $\theta_{2A}$ and $\theta_{2B}$, which creates line 1640 which defines the midpoint 1645 between the radial arm and the adjacent radial arm on the vertical tray edge 160.

Radial arm 1500 may also comprise one or more stops 1510, a key 1520 and a key end 1530.

Figure 6:
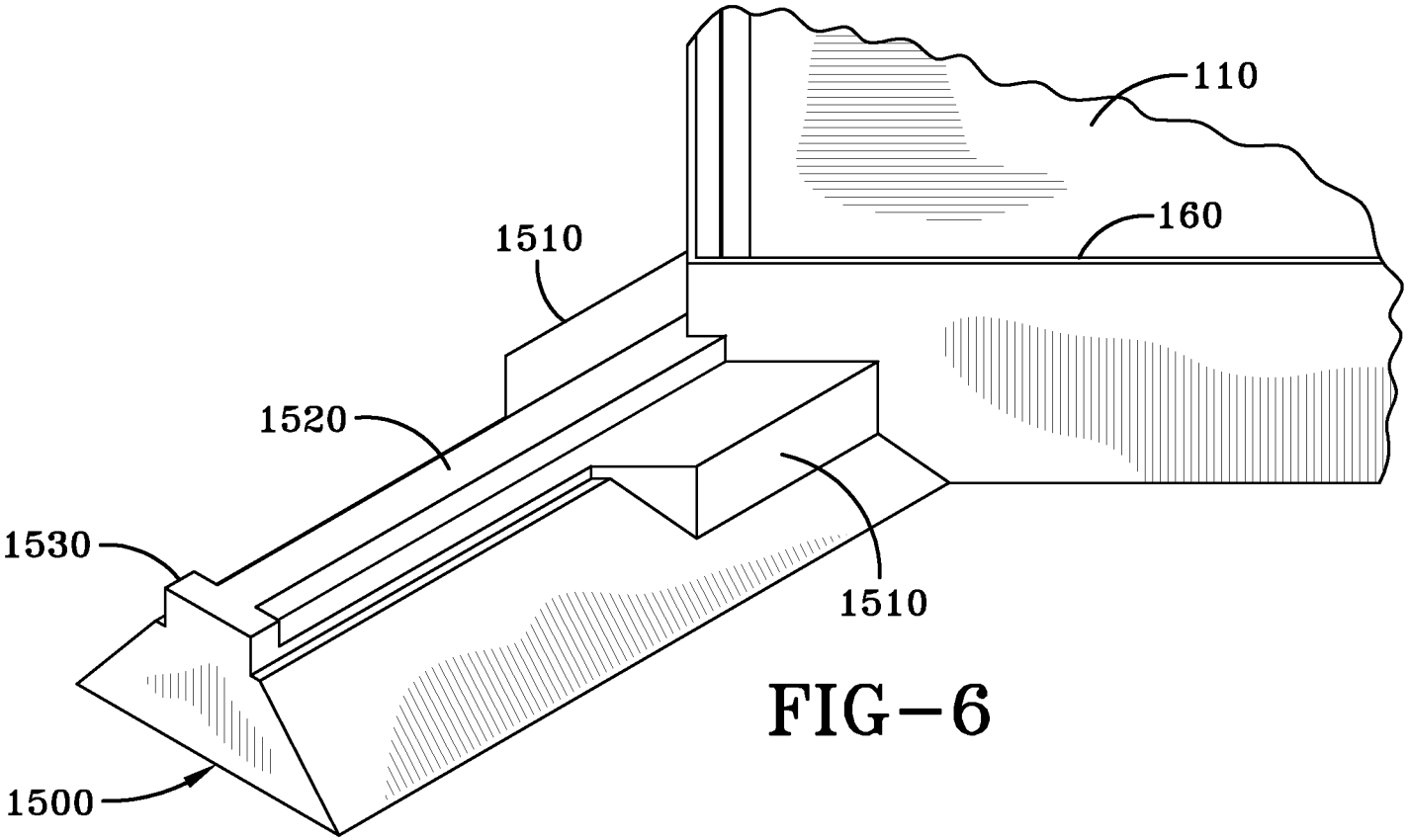
FIG. 6 shows a close-up view of the radial arm.

As shown in FIG. 6, the radial arm may have the stops 1510 as part of its base, with a raised key running down the center of radial arm 1500 with a key end 1530 running perpendicular to the key. It should be noted that the key, the stops and the key end are optional. The radial should be molded or shaped so as to fit in between the gap between the two assembled master tray substrates as shown in FIGS. 26-30, to produce the finished modular floor shown in FIG. 31 or 32.

Figure 7:
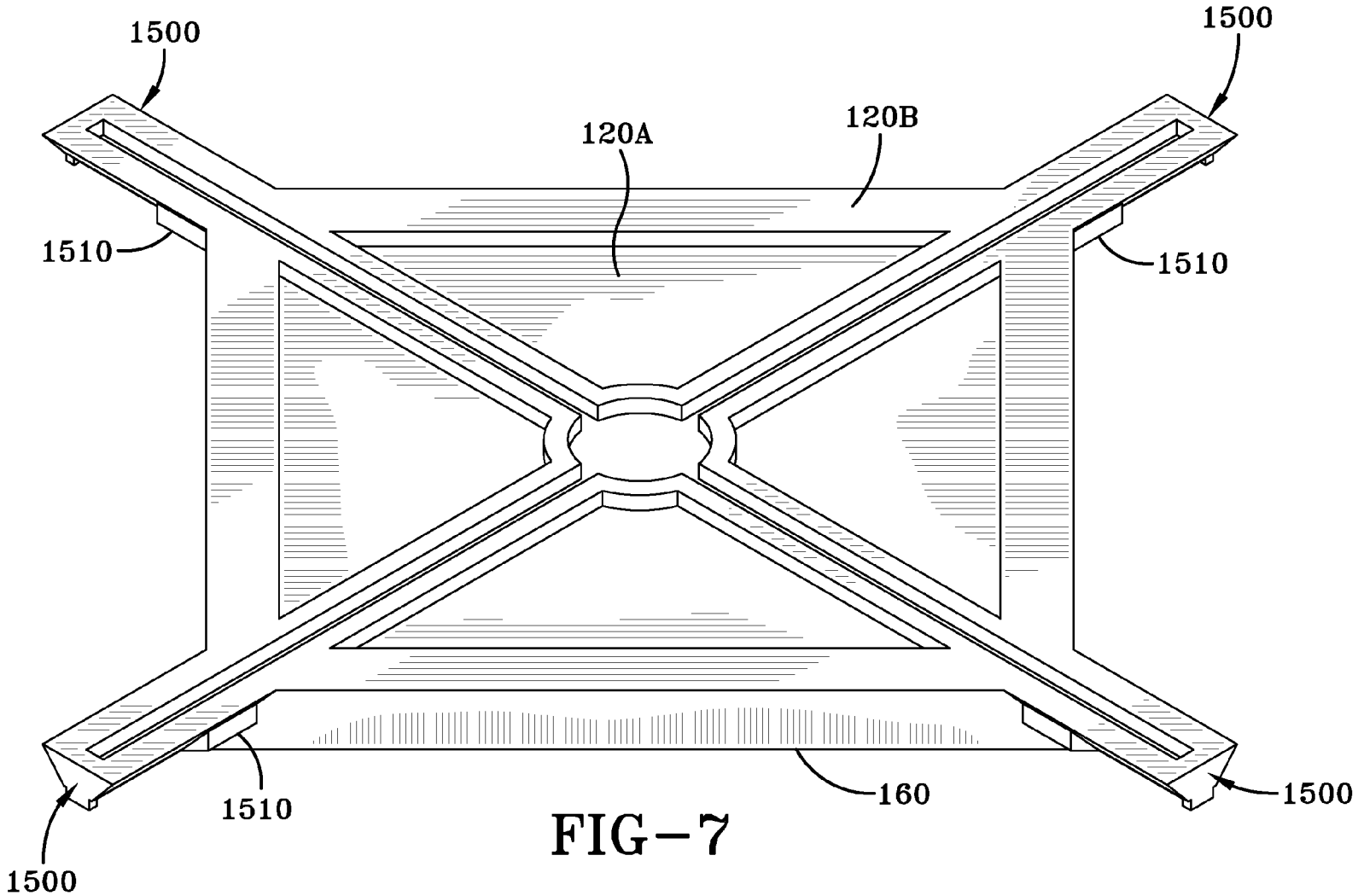
FIG. 7 shows an view of the bottom of the medallion tray substrate.

FIG. 7 is a view of the bottom of the medallion tray substrate with radial arms 1500 and stops 1510. The bottom has a contact surface 120B which touches the floor.

Figure 7A:
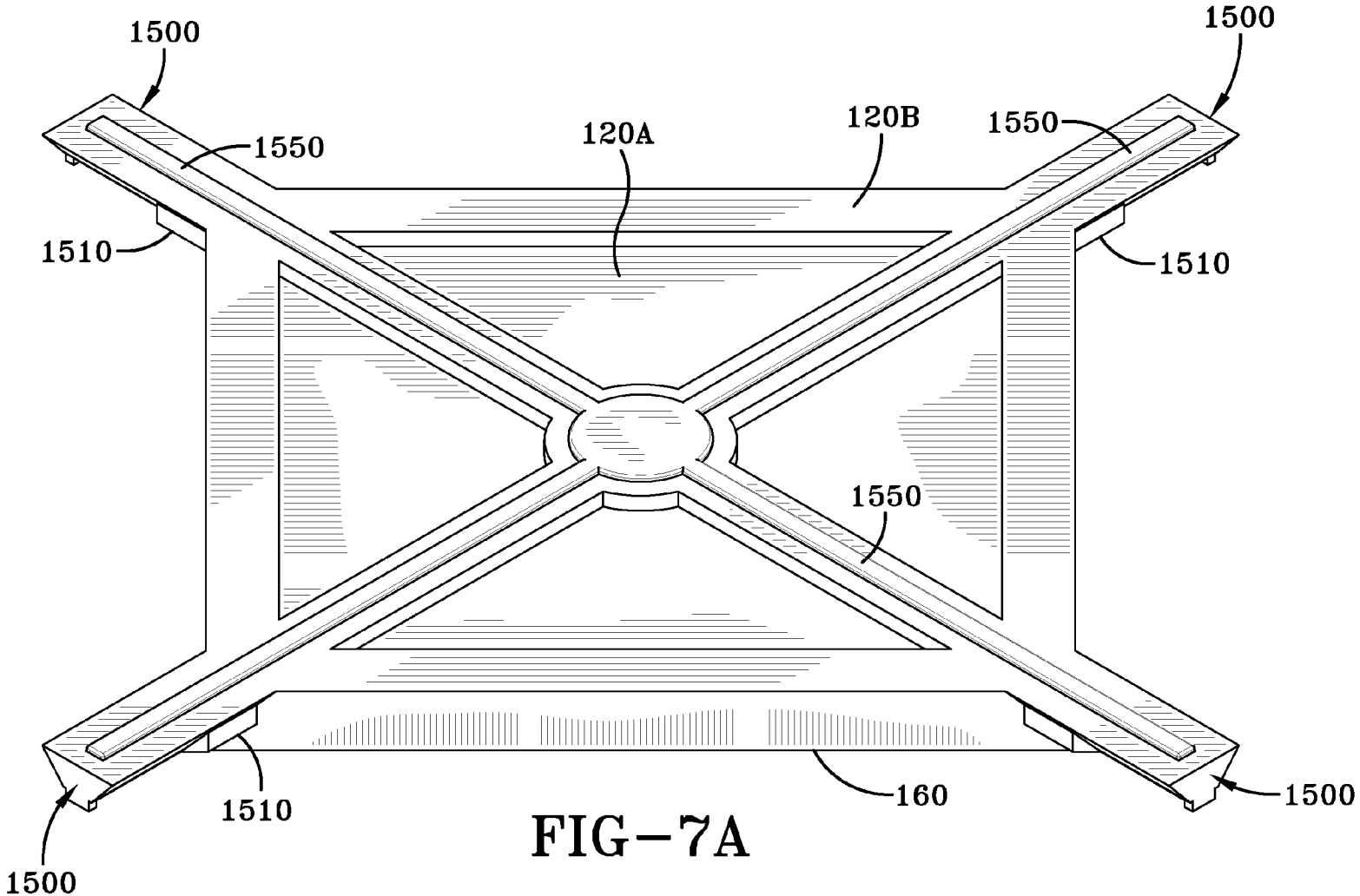
FIG. 7A shows an view of the bottom of the medallion tray substrate with the flooring pad adhered to it.

The bottom may optionally also have a non-contact surface 120A which does not touch the floor. The channels are optional and used to set the optional flooring pad 1550 as shown in FIG. 7A. This provides a positive connection between the optional padding and the tray bottom. Although the flooring pad is optional, it should be slightly raised from the contact surface 120B so that when the medallion tray substrate is compressed and assembled the flooring pad compresses and contact is made between the floor, the flooring pad 1550 and the contact surface 120B. The padding may be over-molded to the tray bottom. This provides a positive connection between the optional padding 500 and the tray bottom 120

Figure 8:
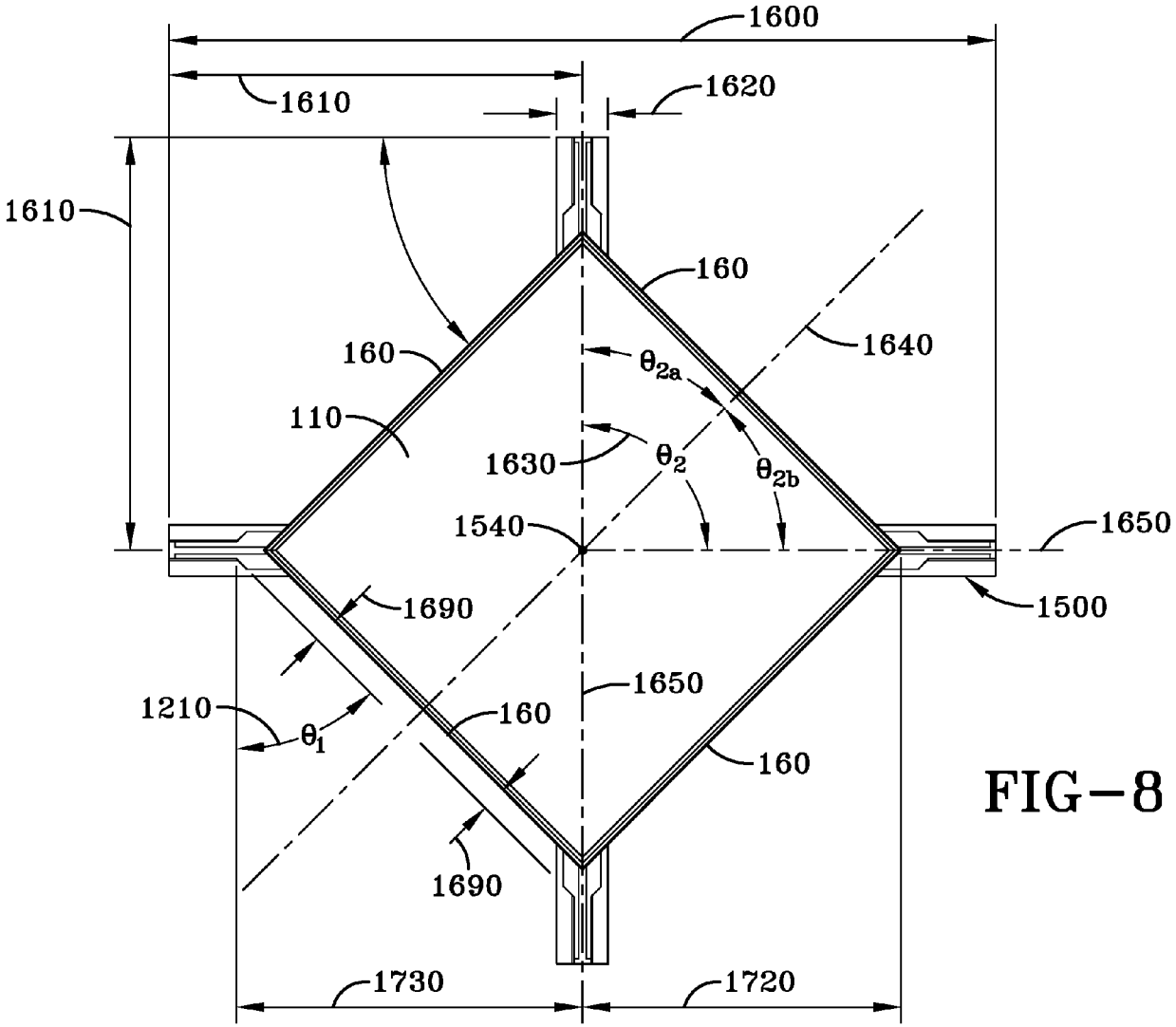
FIG. 8 shows a top view of the medallion tray substrate.

FIG. 8 shows a top view of the square embodiment of the medallion tray substrate. 1600 is the distance between the opposing radial arms. 1610 is the distance from the geometric center 1540 of the radial arms to the end of the radial arm. 1620 is the thickness of a radial arm at its base.

The purpose of the stop is to maintain a constant distance from the master tray substrate. To prevent rocking around the master tray substrate there must be one stop point on one side of the line 1640 and one stop point the other side of 1640. The points which touch the master tray substrate should be the points farthest from the vertical tray edge 160. To keep from the medallion from rocking and keep a constant gap between the medallion and master tray substrates, the distance from the farthest stop point to 160 on one side of 1640 should be substantially the same, if the not the same as the distance from the furthest stop point on the other side to 160. Of course, this is measured perpendicular to the tangent of the tray edge, which in the case of the square of FIG. 8, is the line traced by vertical tray edge 160.

1210 is the angle $\theta_1$ of the line connecting the two points of the stops furthest from the vertical tray edge 160, measured perpendicular to the tangent of the tray substrate edge and the line perpendicular to the radial arm. This angle should be substantially the same as $\theta_{2A}$ and $\theta_{2B}$ which is the bisection of the angle 1630, $\theta_2$.

1690 is the distance between the vertical tray edge 160 and line connecting the two outermost points of the stops as measured perpendicular to the tangent of the edge of the medallion tray substrate. 1720 is the distance from the geometric center of the radial arms to the end of the stop on a radial arm.

FIG. 9 shows the vertical tray edges as not being continuous around the perimeter but having gaps 170. FIG. 9 also has a point 180, which is the reference corner of the intersection of two the vertical tray edges.

Figure 10:
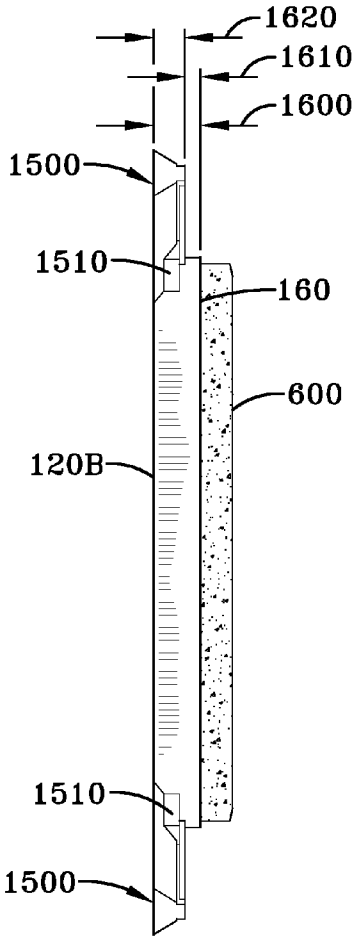
FIG. 10 shows a view of the medallion modular flooring assembly.

FIG. 10 is a sideview of FIG. 8 with the flooring component 600 adhered to the tray surface. It shows the height of the vertical tray edge being less than the height of the flooring component. 1600 is the height of the top of the vertical tray edge measured from the contact surface of the bottom 120B. 1610 is the distance from the top of the radial arm to the top of the vertical tray surface. In some embodiments, this distance may be zero, or the top of the radial arm could be higher than the vertical tray edge. 1620 is the distance from the contact surface to the top of the radial arm.

Figure 11:
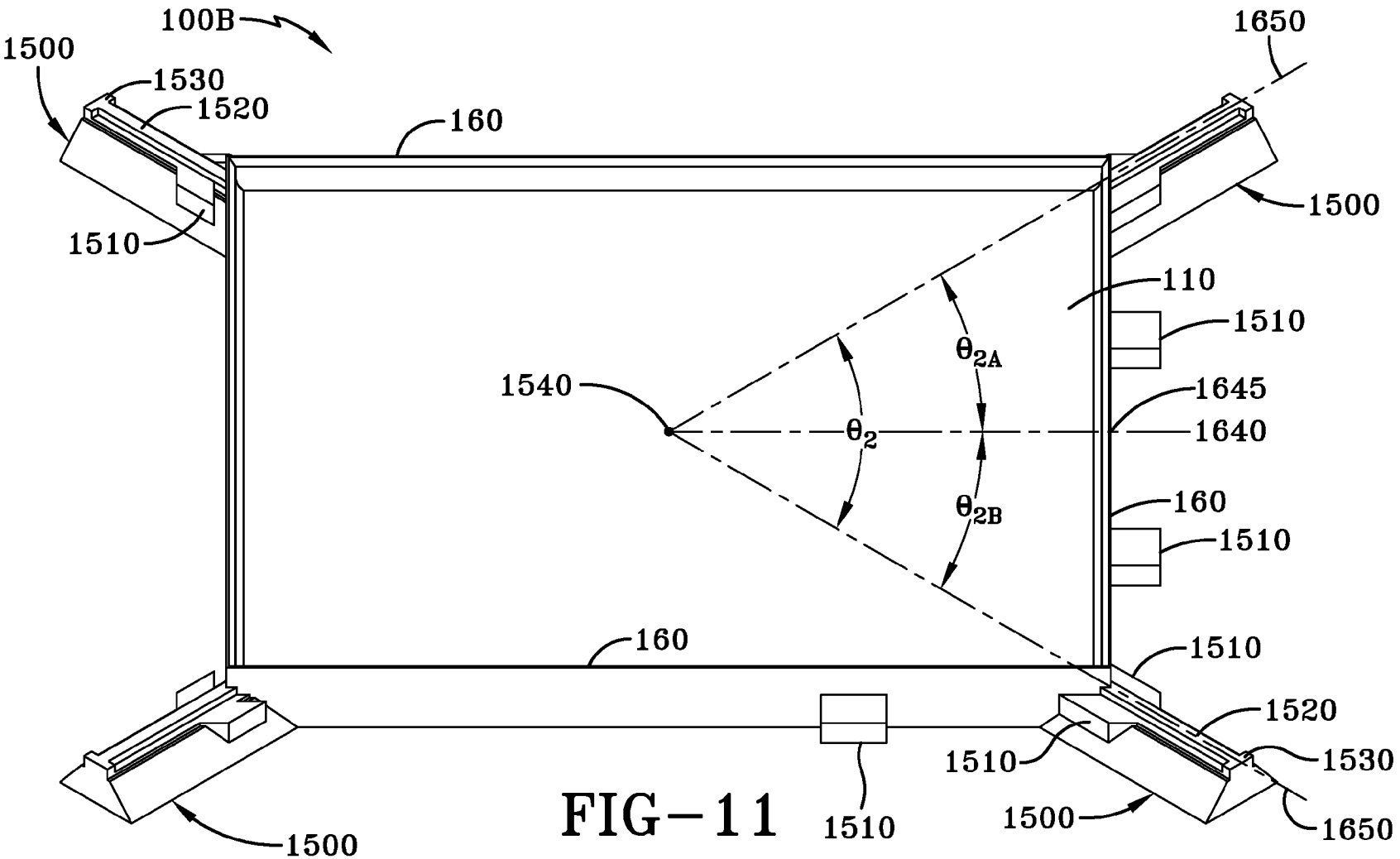
FIG. 11 shows a bottom view of the square embodiment.

FIG. 11 shows different embodiments of the various stops. The stop 1510 in the upper right hand corner does not touch or extend from the side of the medallion tray substrate, rather it is exclusively part of the radial arm. The left hand side of the figure shows two horizontal stops one either side of 1640 which are not part of a radial arm. The bottom side of the figure shows a single stop which is not part of a radial arm and a stop which is exclusively part of the radial arm on the lower left hand side.

Figure 12:
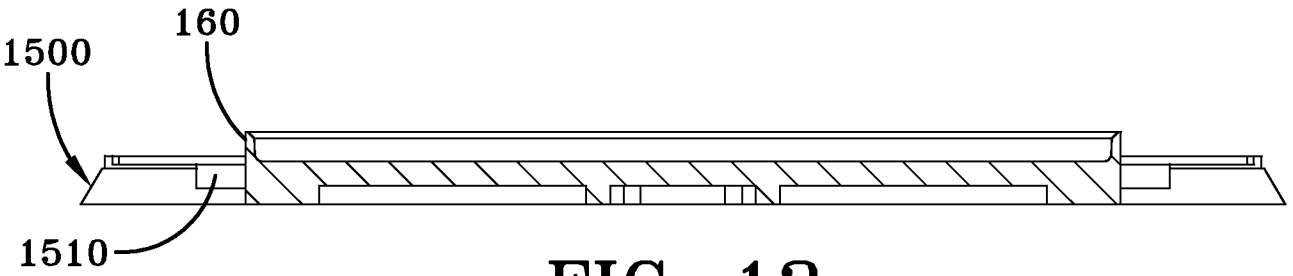
FIG. 12 is a cutaway view of the medallion tray substrate.
Figure 13:
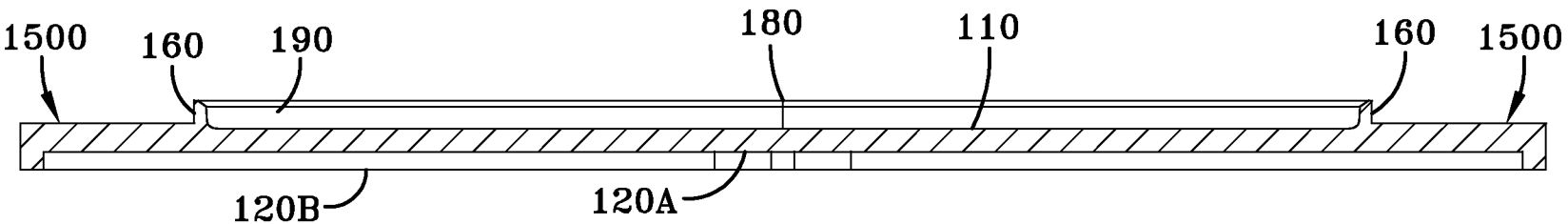
FIG. 13 is a cutaway view of the medallion tray substrate.

FIGS. 12 and 13 are cutaway views of FIG. 9 and show the tray as it looks without the flooring component adhered to 110.

Figure 15:
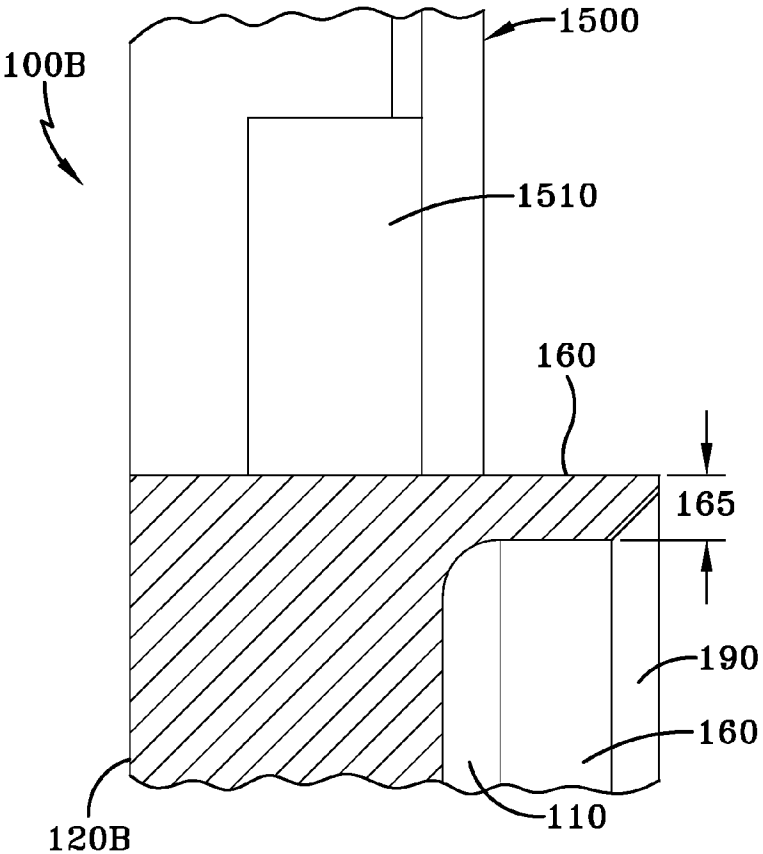
FIG. 15 shows a close up view of the vertical tray edges.
Figure 14:
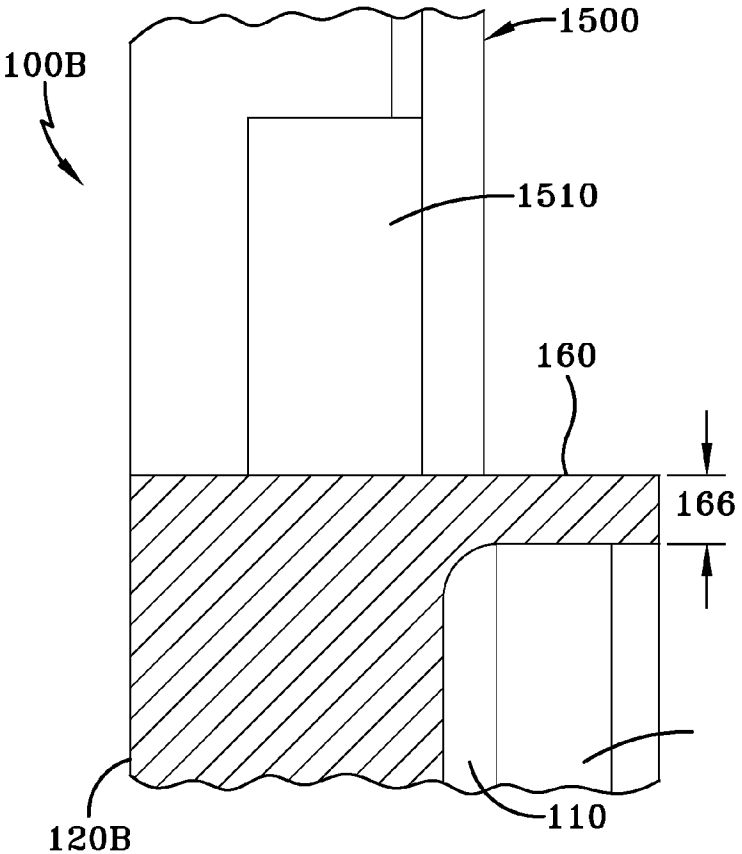
FIG. 14 shows a close up view of the vertical tray edges.

FIGS. 14 and 15 depict two embodiments of the vertical tray edges. While it is preferable to have the tray edge slightly tilted as shown in FIG. 15, 165, it is perfectly acceptable to have the tray edge square as shown at 166, FIG. 14.

Figure 16A:
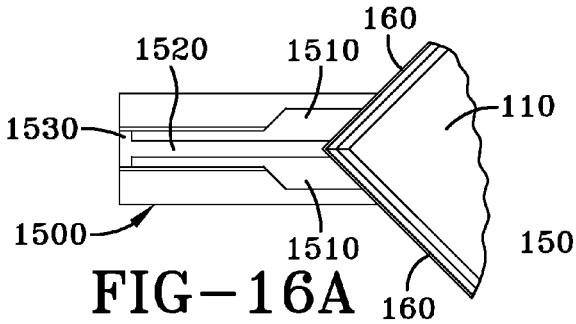
FIG. 16A shows an embodiment of a radial arm.
Figure 16B:
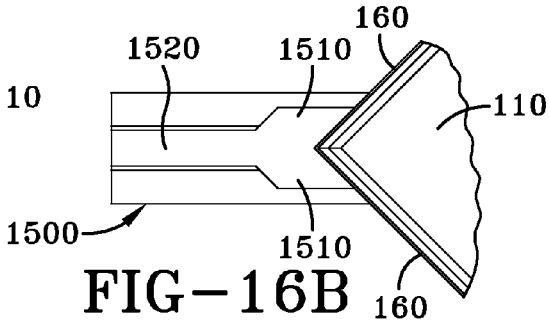
FIG. 16B shows an embodiment of a radial arm.
Figure 17:
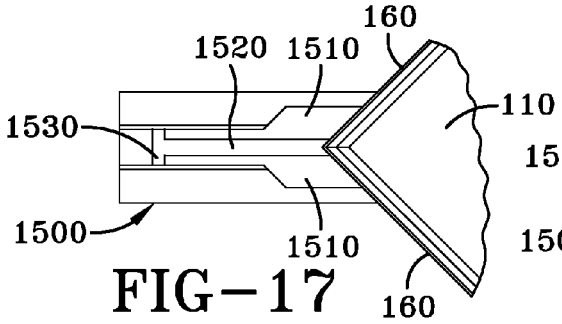
FIG. 17 shows an embodiment of a radial arm.
Figure 18:
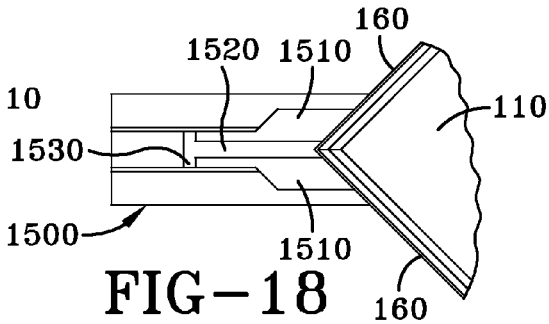
FIG. 18 shows an embodiment of a radial arm.
Figure 19:
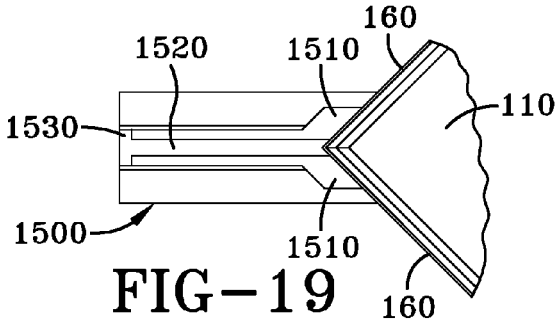
FIG. 19 shows an embodiment of a radial arm.
Figure 20:
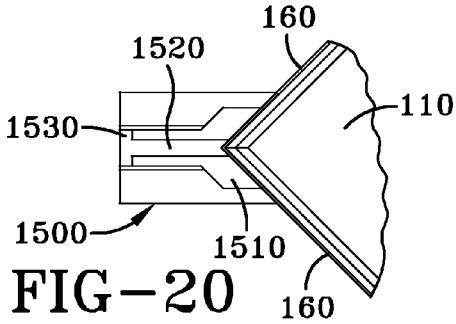
FIG. 20 shows an embodiment of a radial arm.

FIGS. 16A-20 show alternative embodiments of the radial arm relative to the optional key and key end design. FIG. 16A depicts the previous embodiment, while FIG. 16B shows a thicker key without the key end 1530. FIGS. 17 and 18 show the key end at various points along the redial arm, thus making the distance from the stop to the key end longer or shorter. FIGS. 19 and 20 contrast shorter and longer radial arms to achieve distance between the stop and the key end similar to that of FIG. 18.

Figure 21:
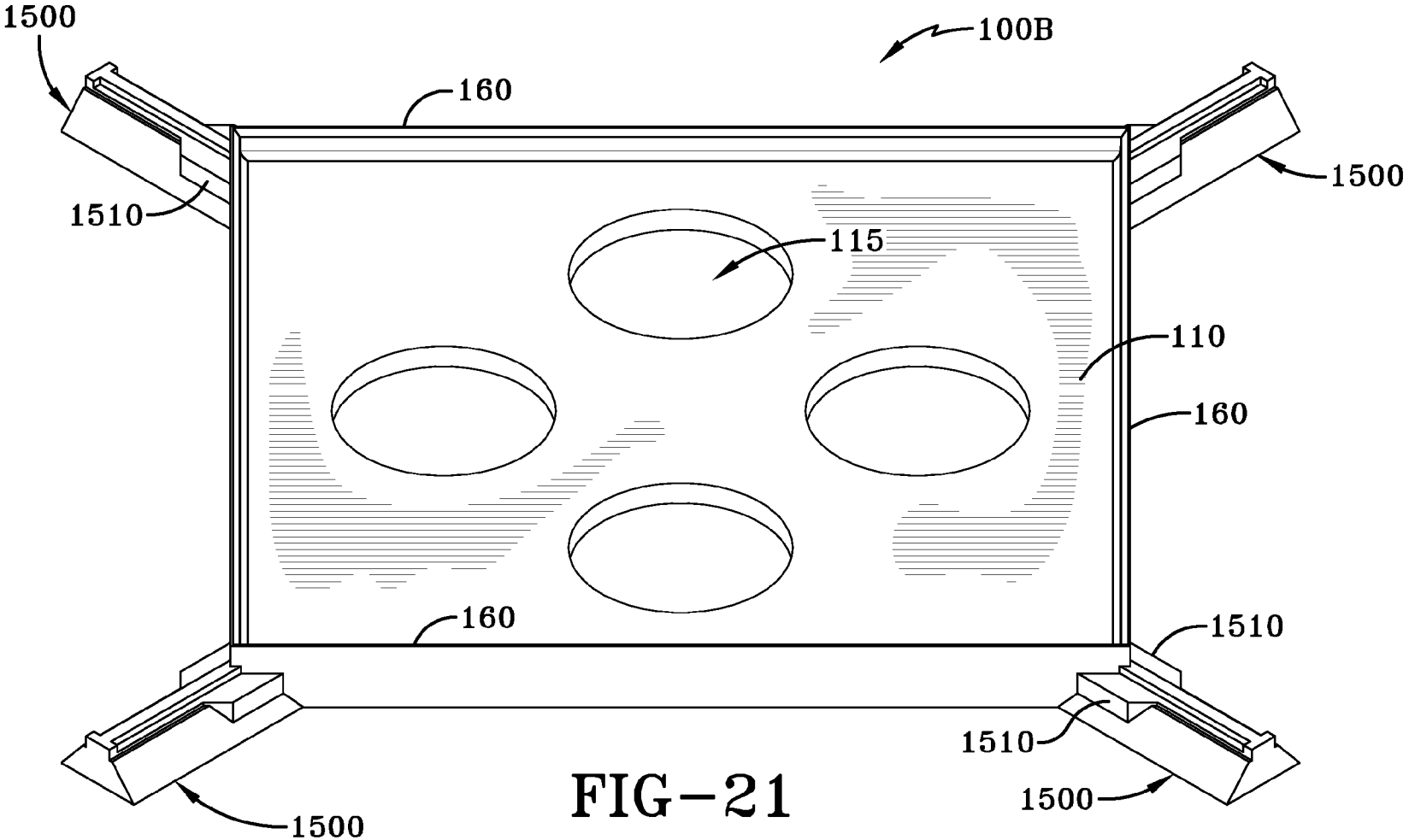
FIG. 21 shows an alternate embodiment of the medallion tray substrate.

FIG. 21 is an embodiment where there are actual holes 115 passing from through the horizontal tray surface to the bottom which could be either the contact surface or the non-contact surface.

Figure 22:
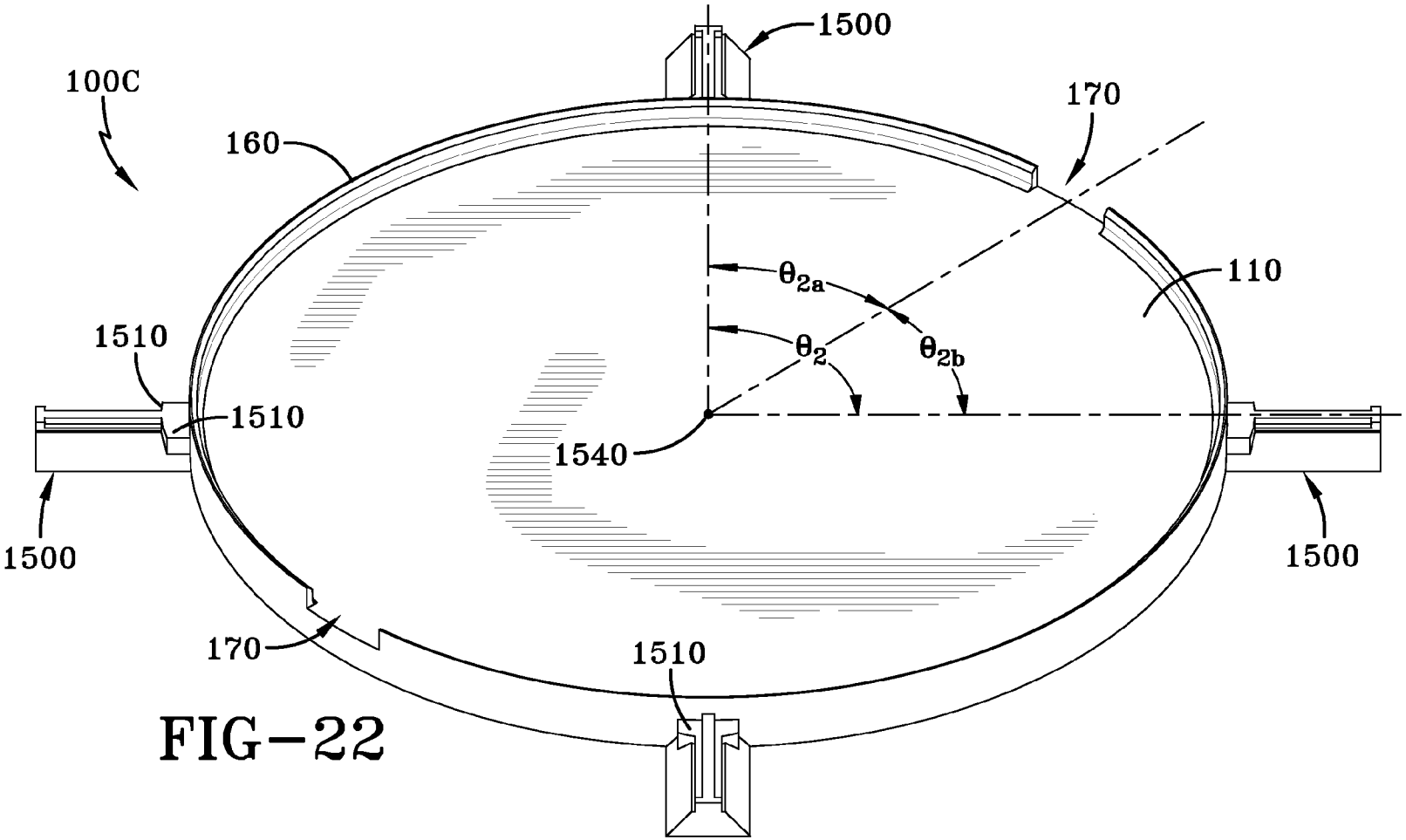
FIG. 22 shows a perspective view of a circular medallion tray substrate.

FIG. 22 is an alternate embodiment of the medallion tray substrate 100C in a circular medallion. This embodiment can have all the features of the square embodiment except that the stops, 1510 should be, but do not have to be contoured in an arc following the arc of made by the vertical edges 160. In this manner, the stop follows the trace defined by the vertical edges.

Figure 23:
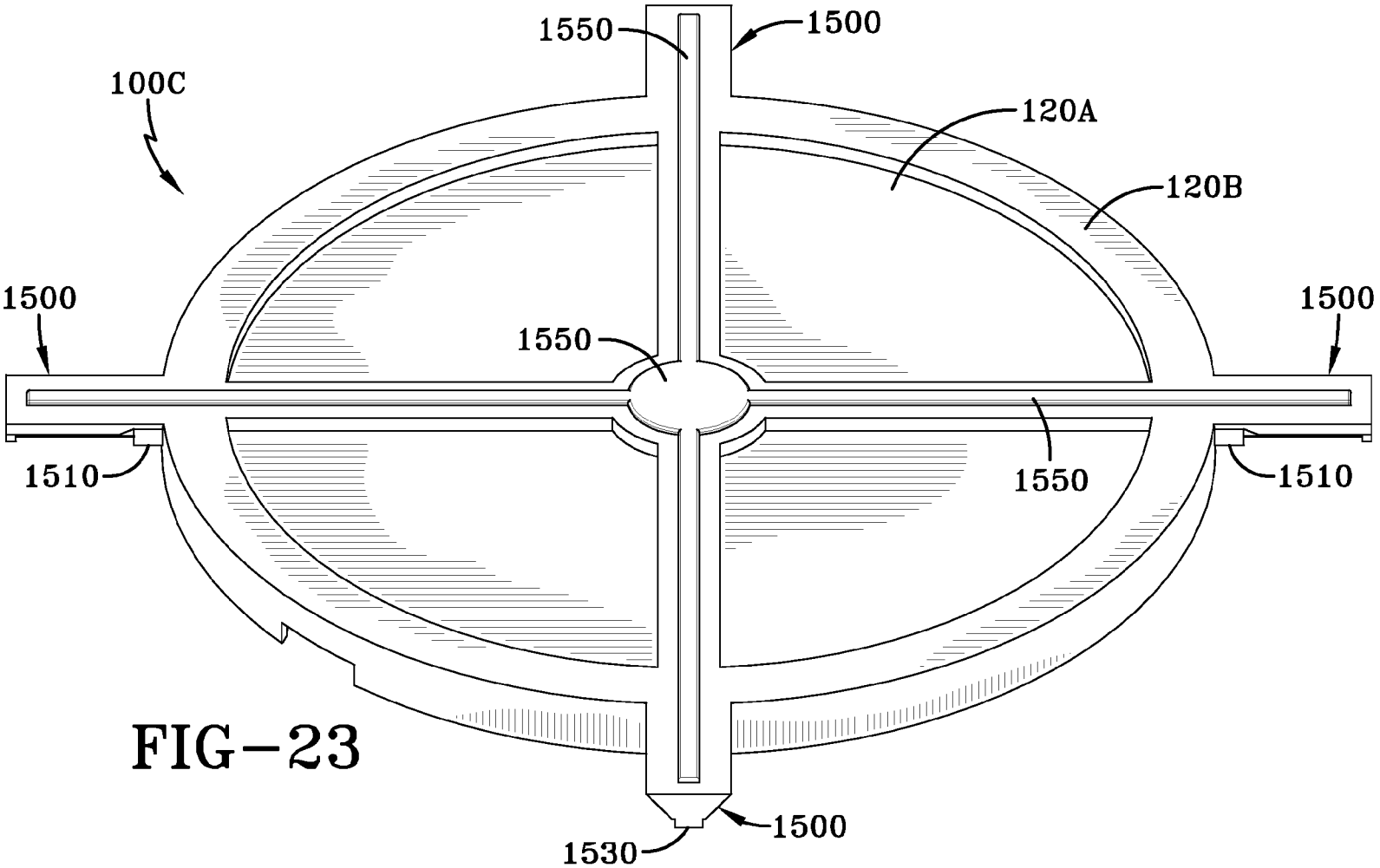
FIG. 23 shows a bottom perspective of a circular medallion tray substrate.
Figure 24:
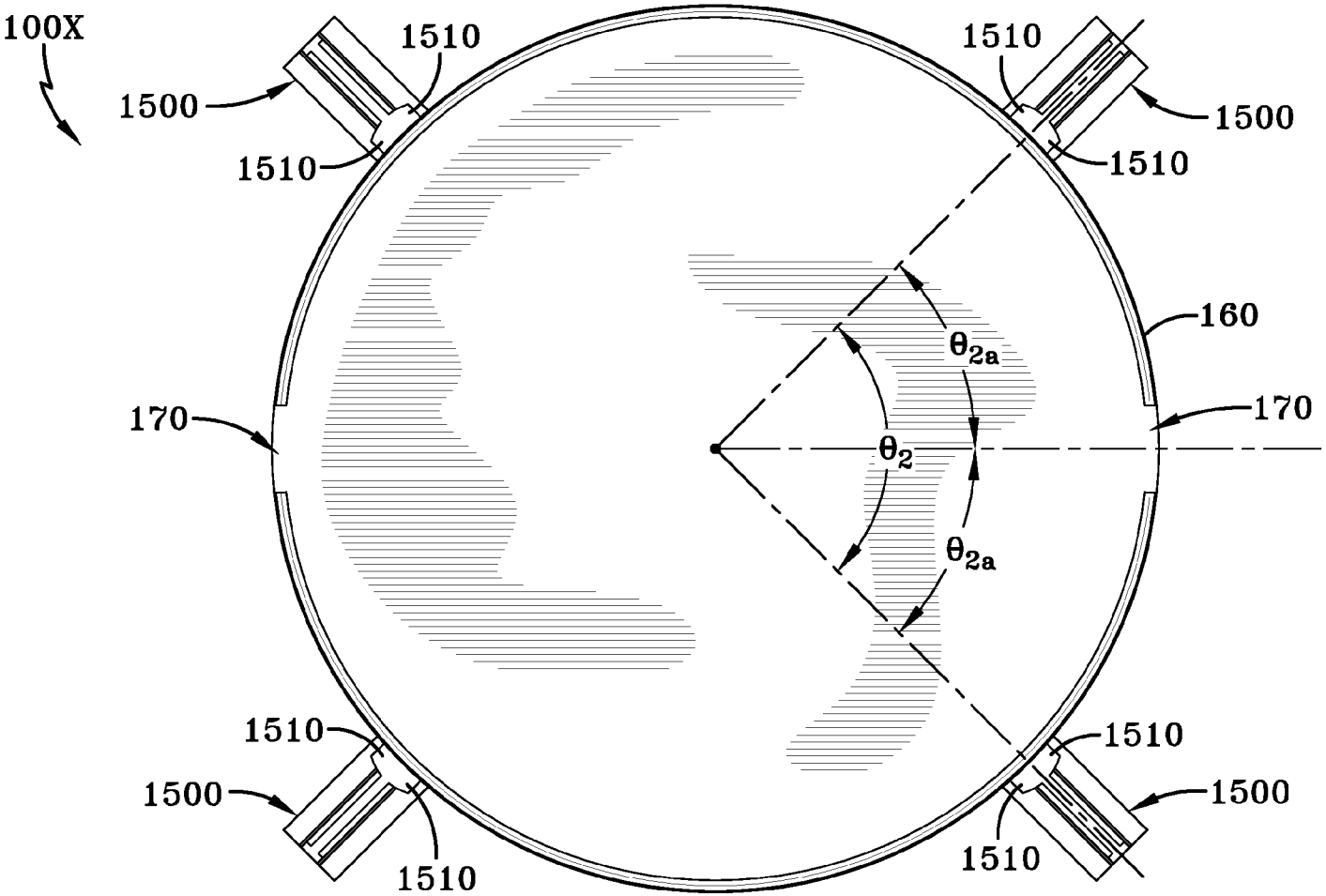
FIG. 24 shows a top perspective of a circular medallion tray substrate.
Figure 25:
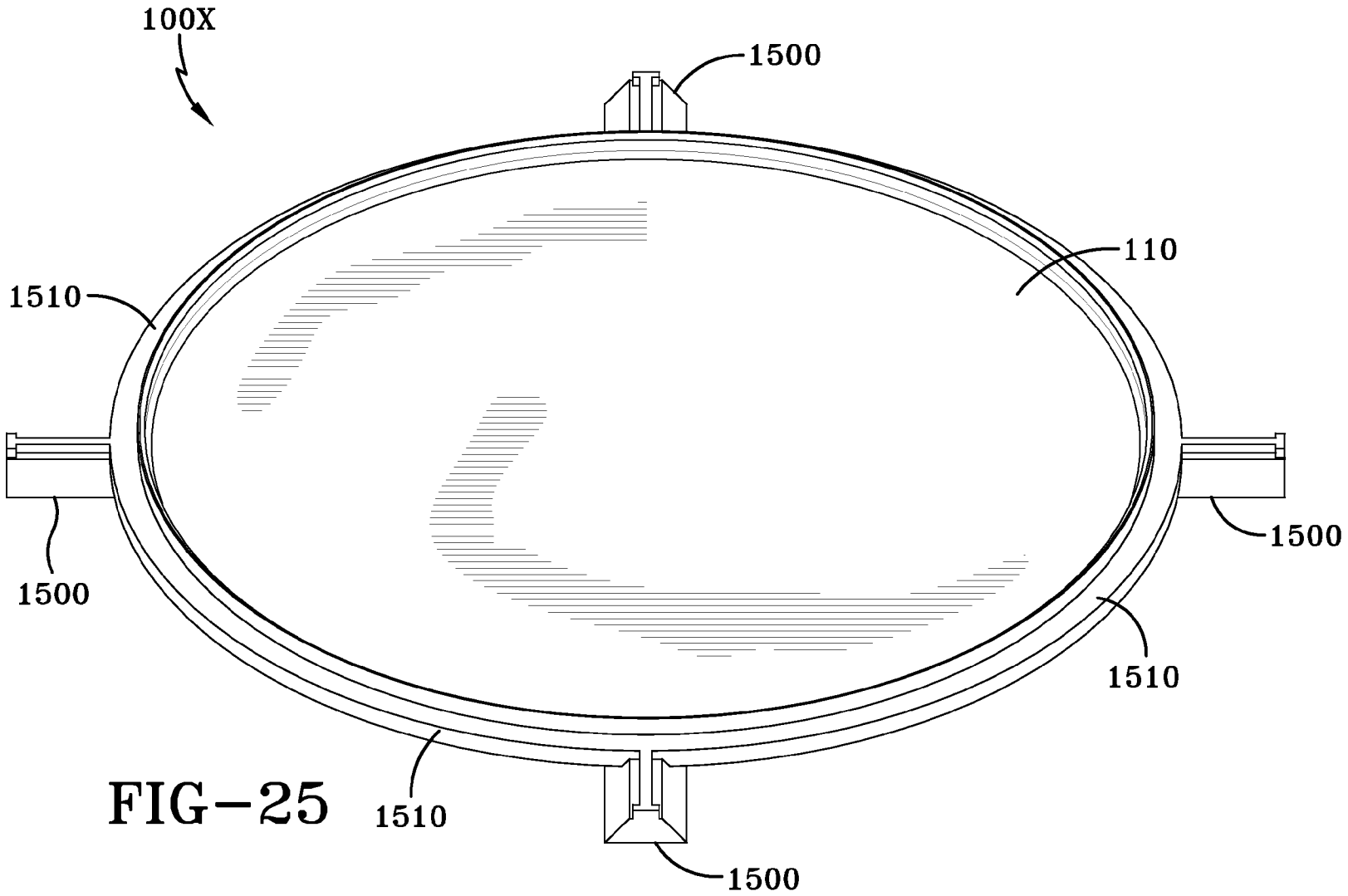
FIG. 25 shows a top perspective of a circular medallion tray substrate, but with continuous stop.

FIG. 23 is the bottom view of the circular medallion tray substrate 100C. FIG. 24 is a top view showing the circular medallion tray substrate Two or more stops are not necessary. There must merely be two outermost points which can keep the gap open. As shown in FIG. 15, the stop 1510 is continuous, running around the perimeter of the tray substrate. While in this instance there are not two stops between each radial arm, the two most outer points on either side of the midpoint between the two radial arms are the same, thus the gap between the medallion and master tray substrates is kept constant and the medallion tray substrate will not rock and go out of alignment with the master tray substrate.

Figure 26:
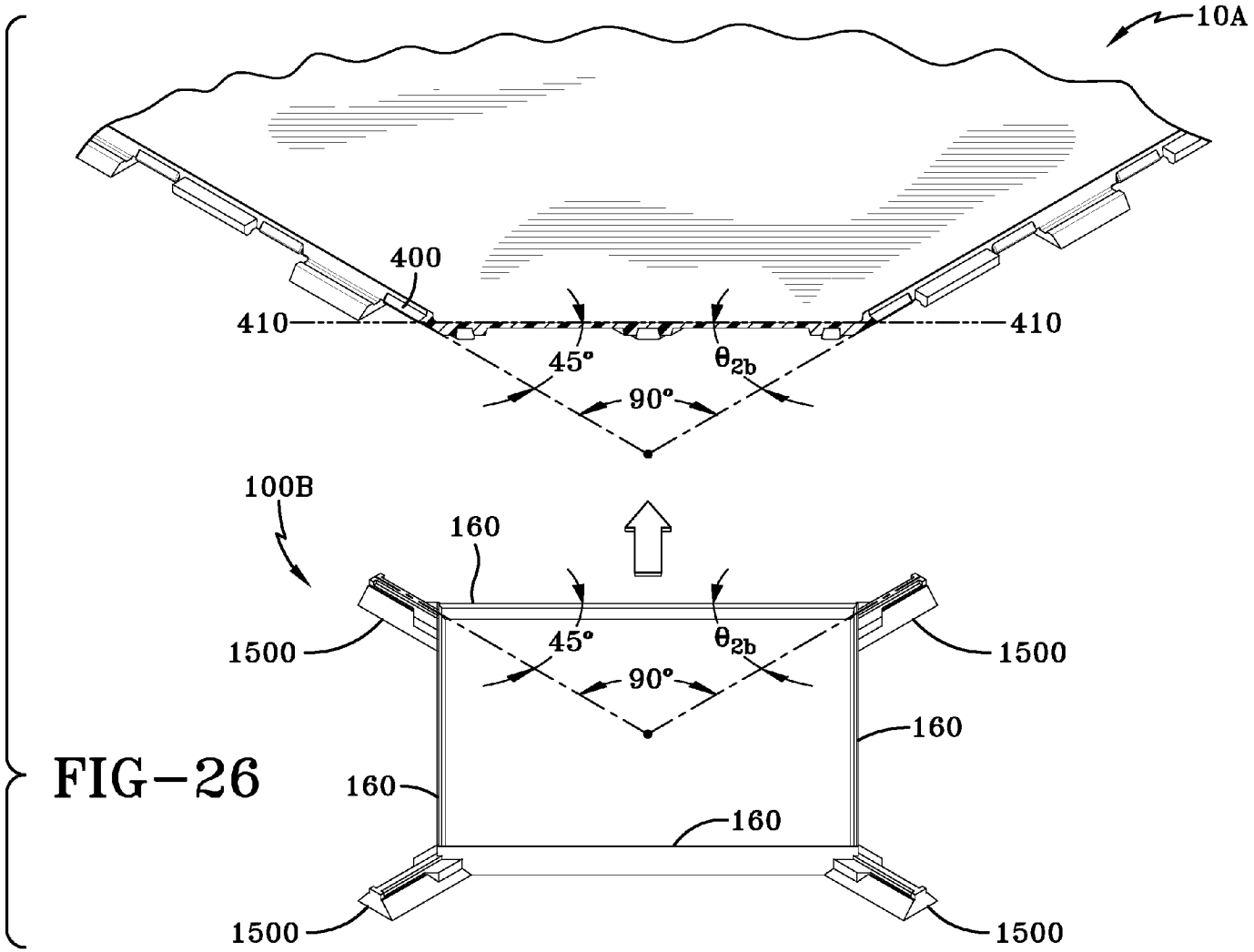
FIG. 26 shows the beginning of the assembly of the medallion tray substrate to the master tray substrate.
Figure 27:
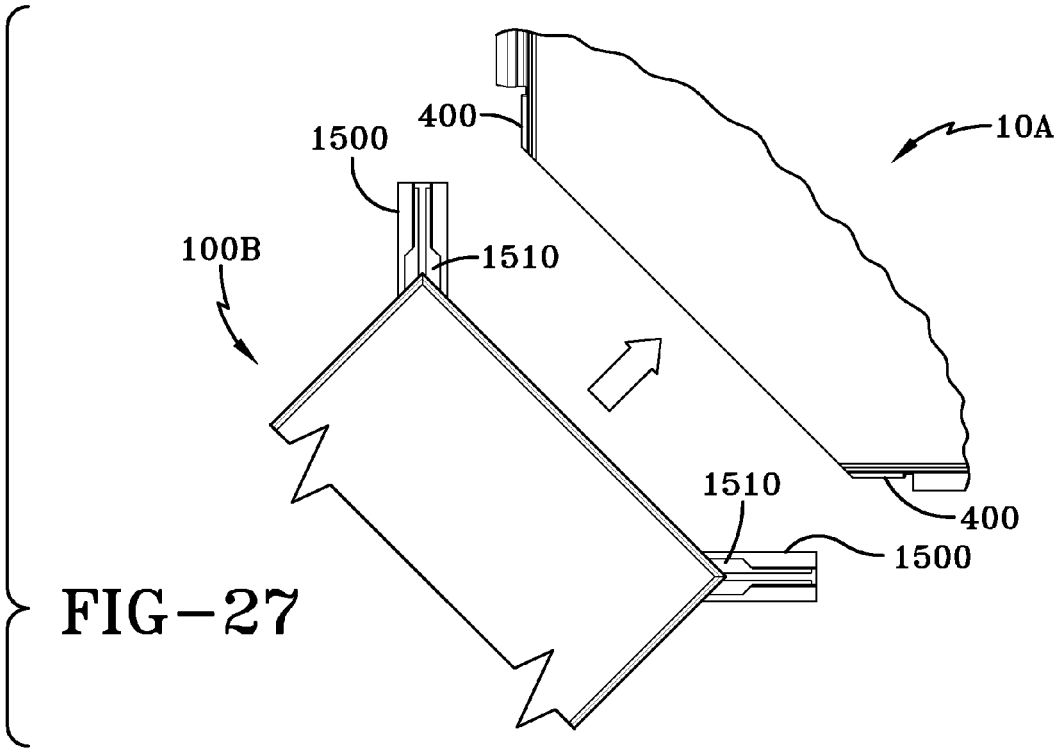
FIG. 27 shows an enlarged view of the beginning of the assembly of the medallion tray substrate to the master tray substrate.
Figure 27A:
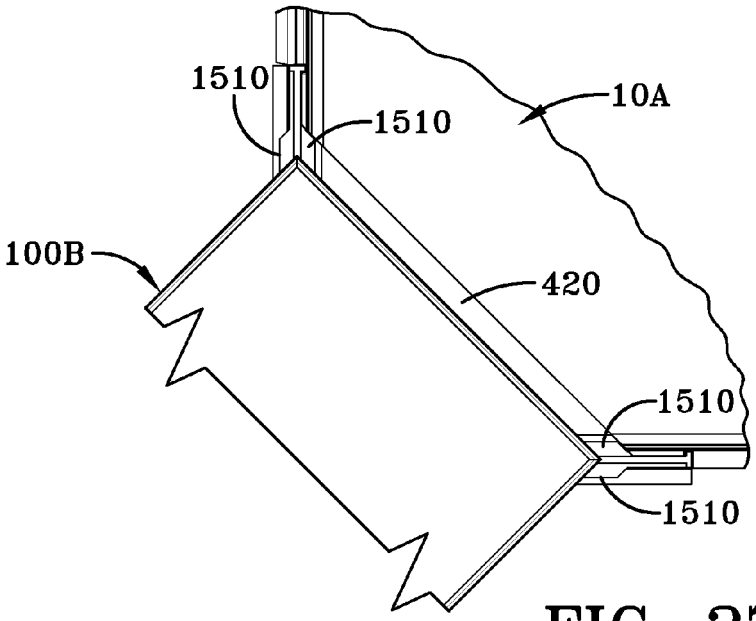
FIG. 27A shows a view of the medallion tray substrate assembled to the master tray substrate.
Figure 28:
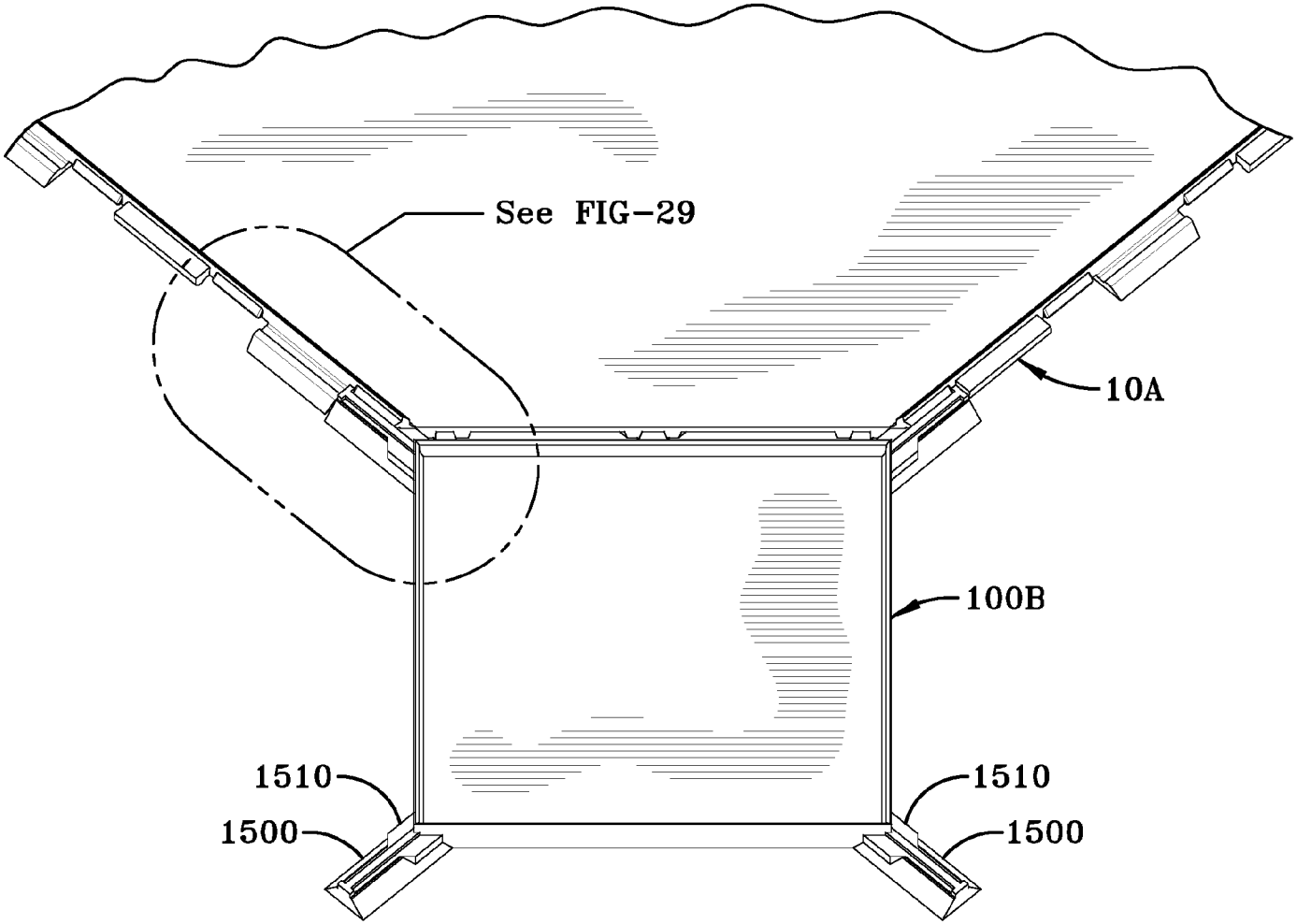
FIG. 28 shows a perspective view of the medallion tray substrate assembled to the master tray substrate.
Figure 29:
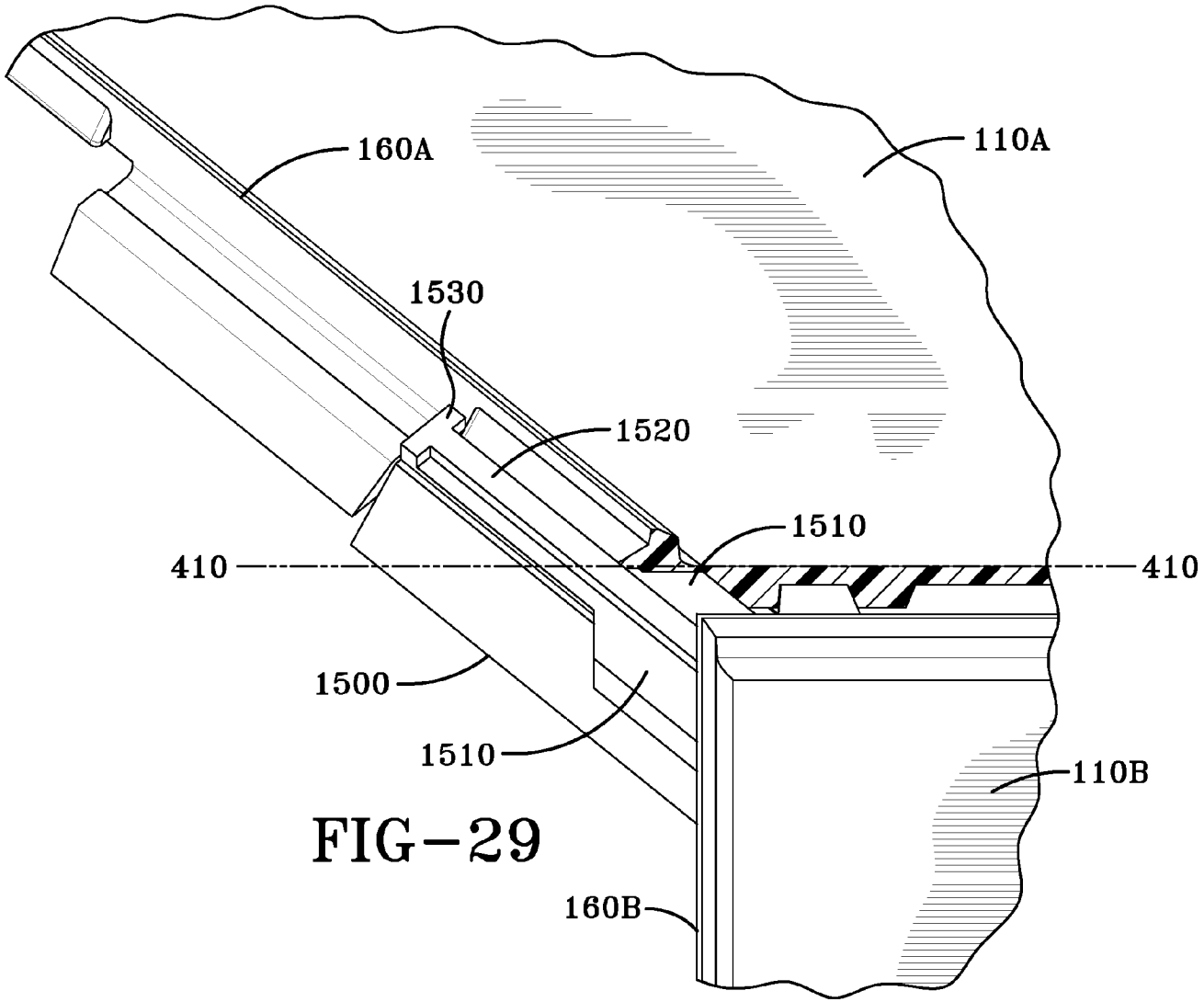
FIG. 29 shows an enlarged view of the radial arm interacting with the master tray substrate.

FIGS. 26-30 show the assembly or mating of the master tray substrate 10A with the medallion tray substrate 100B. FIG. 26 shows the master tray substrate 10A, cut along line 410 to create the isosceles triangle shown in the cutaway. FIG. 27 shows an enlarged view, showing the grout members 400. FIG. 27A shows the medallion tray substrate and the role played by the stops 1510 on the radial arms 1500 to preserve the gap 420 and keep it consistent. FIG. 28 shows a perspective view of the same assembly FIG. 29 shows one assembly. While the key and key end are not essential, the advantage is apparent that if properly spaced, the end of the key 1530 will lock the medallion tray substrate with the grout member from pulling away from the master tray substrate along the slot, while the stop 1510 prevents the medallion tray substrate from being pushed further along the master tray substrate, thus keeping the gap between the two tray substrates. The actual flooring assembly would contain a flooring component 600 adhered to surface 110A of the master tray substrate and a flooring component adhered to the surface of the medallion tray substrate 110B.

Figure 30:
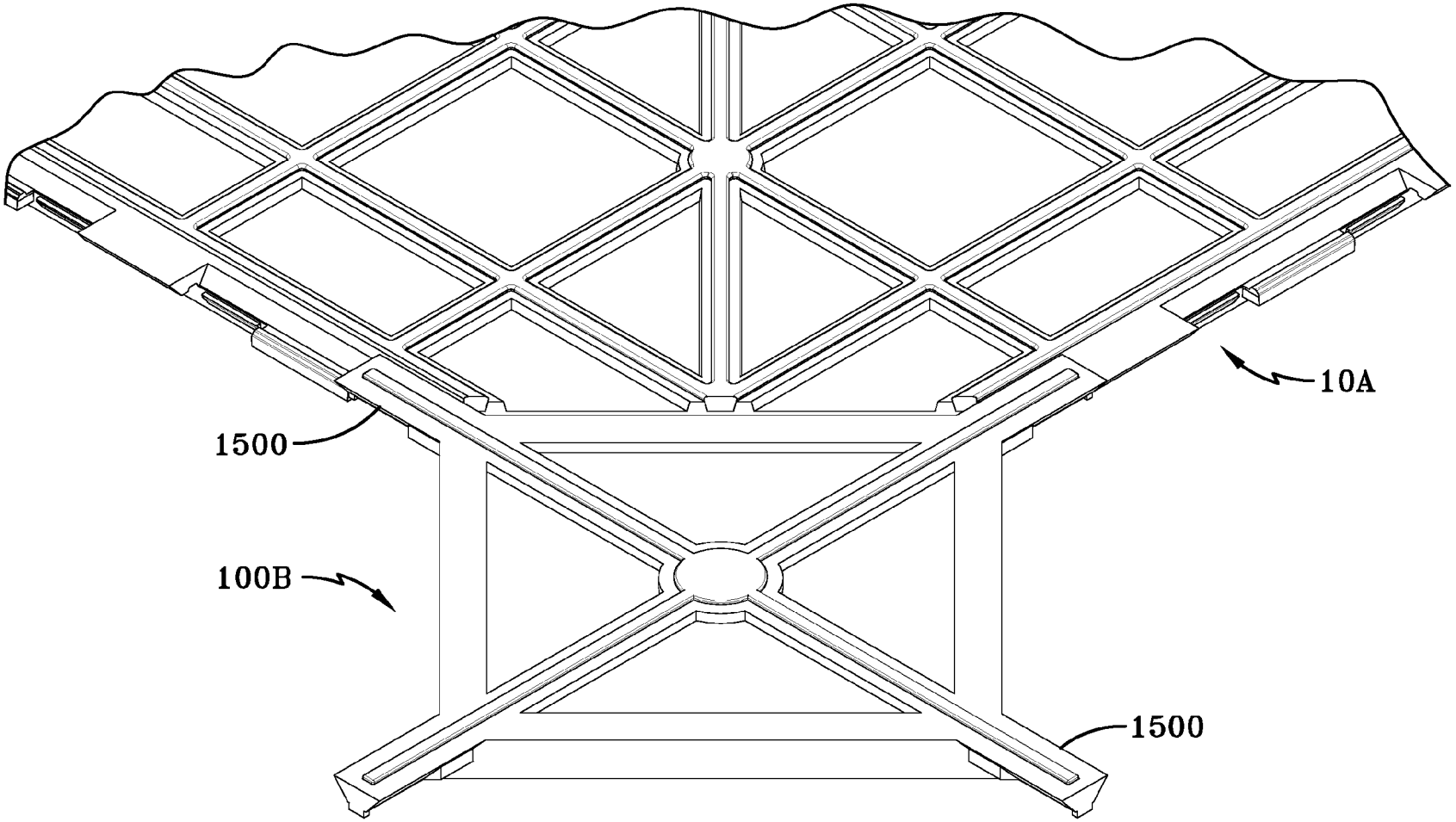
FIG. 30 shows a bottom view of the medallion tray substrate assembled to the master tray substrate.

FIG. 30 shows the bottom view of the medallion tray substrate assembled to the master tray substrate.

Figure 31:
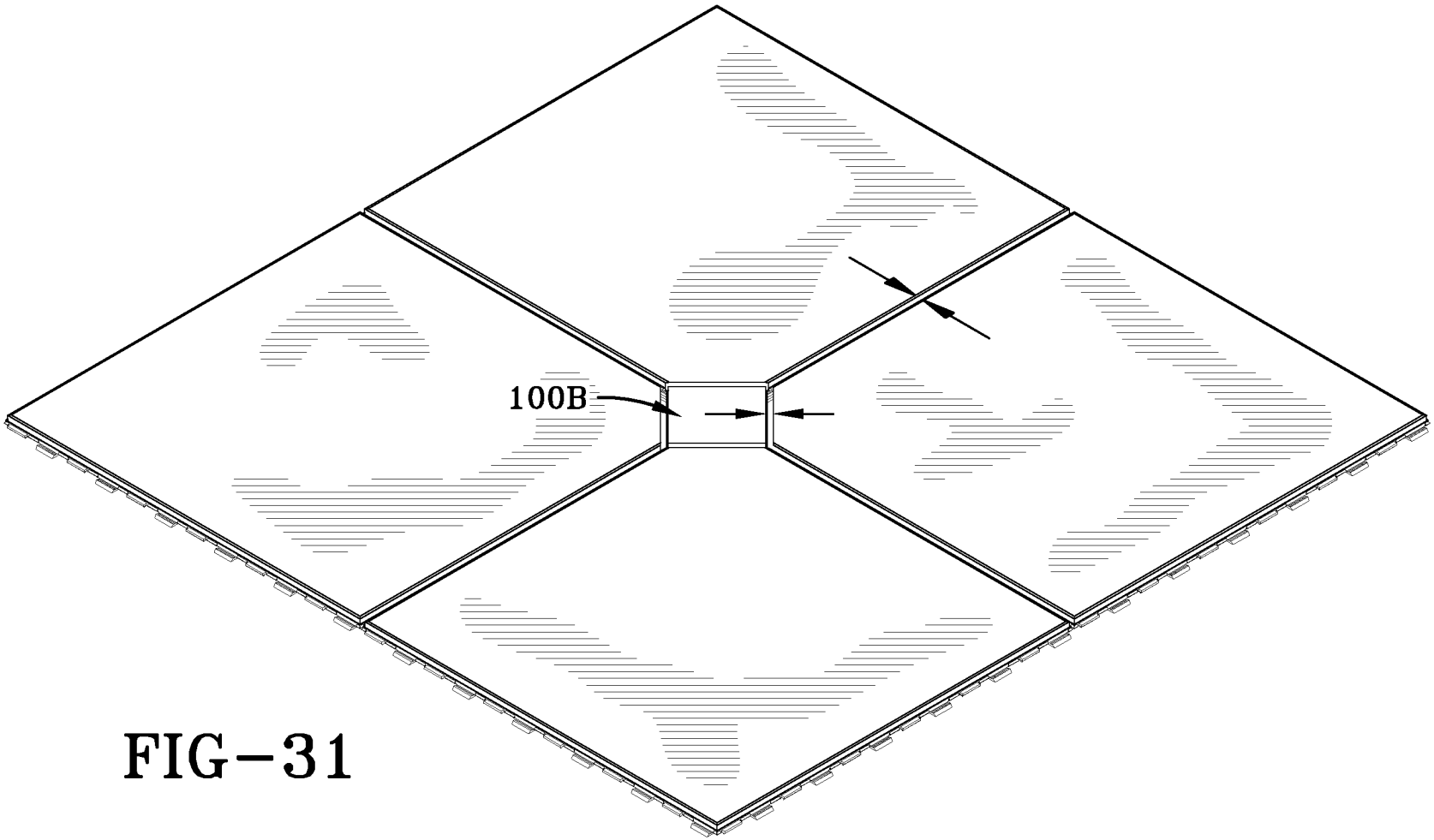
FIG. 31 shows the medallion a tray substrate assembled to four master tray substrates.

FIGS. 31 and 30 show the square and circular medallion tray substrates respectively assembled within four master tray substrates. FIG. 31 shows the square medallion tray substrate inside the four master tray substrates. The arrows depict a relatively constant gap. The assembled modular floor would have the five flooring components and be ready to be grouted, using either the fill in grout or the snap-in grout, or other type of grout.

Figure 32:
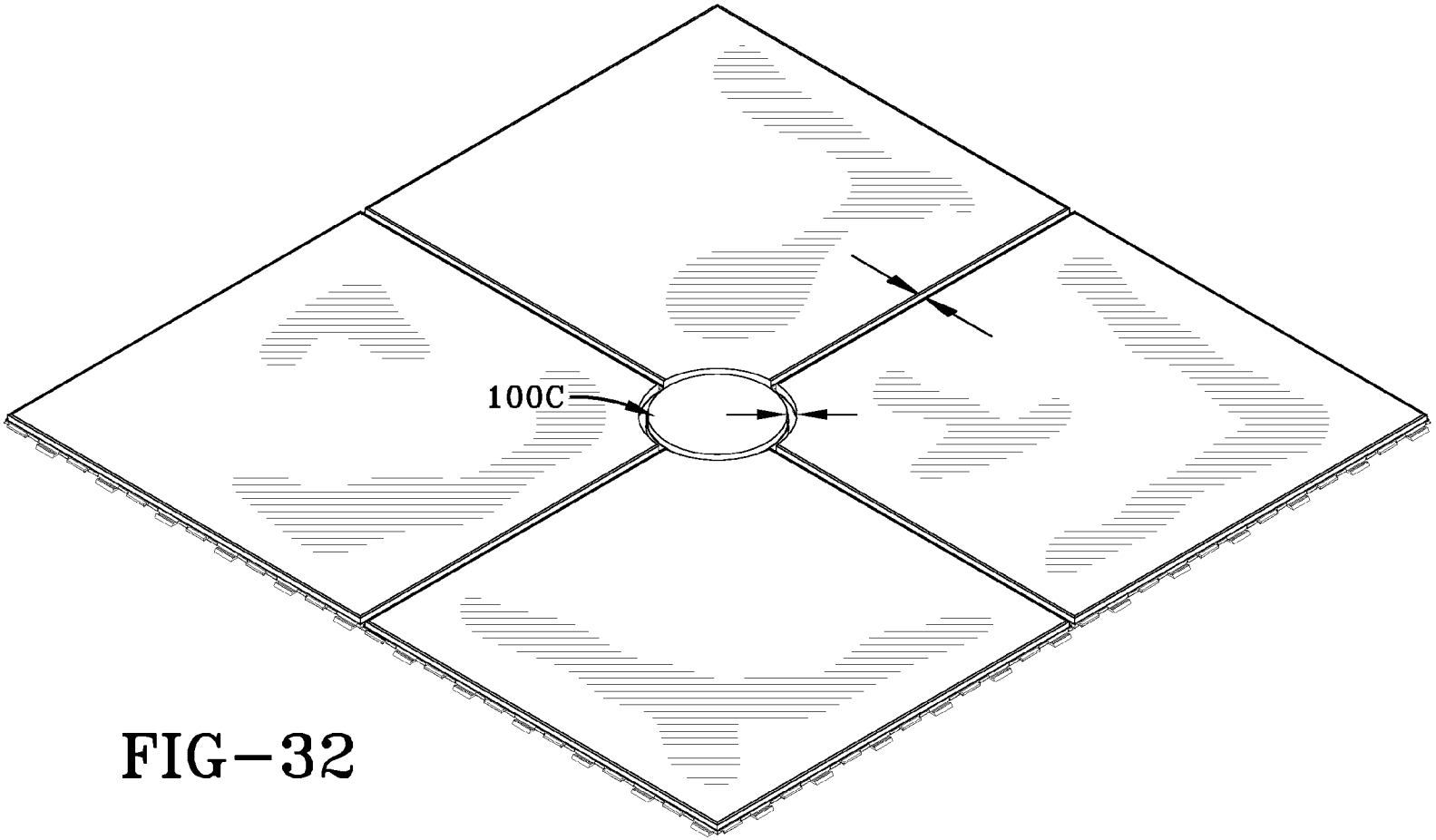
FIG. 32 shows a circular medallion assembled to four master tray substrates.
Figure 33:
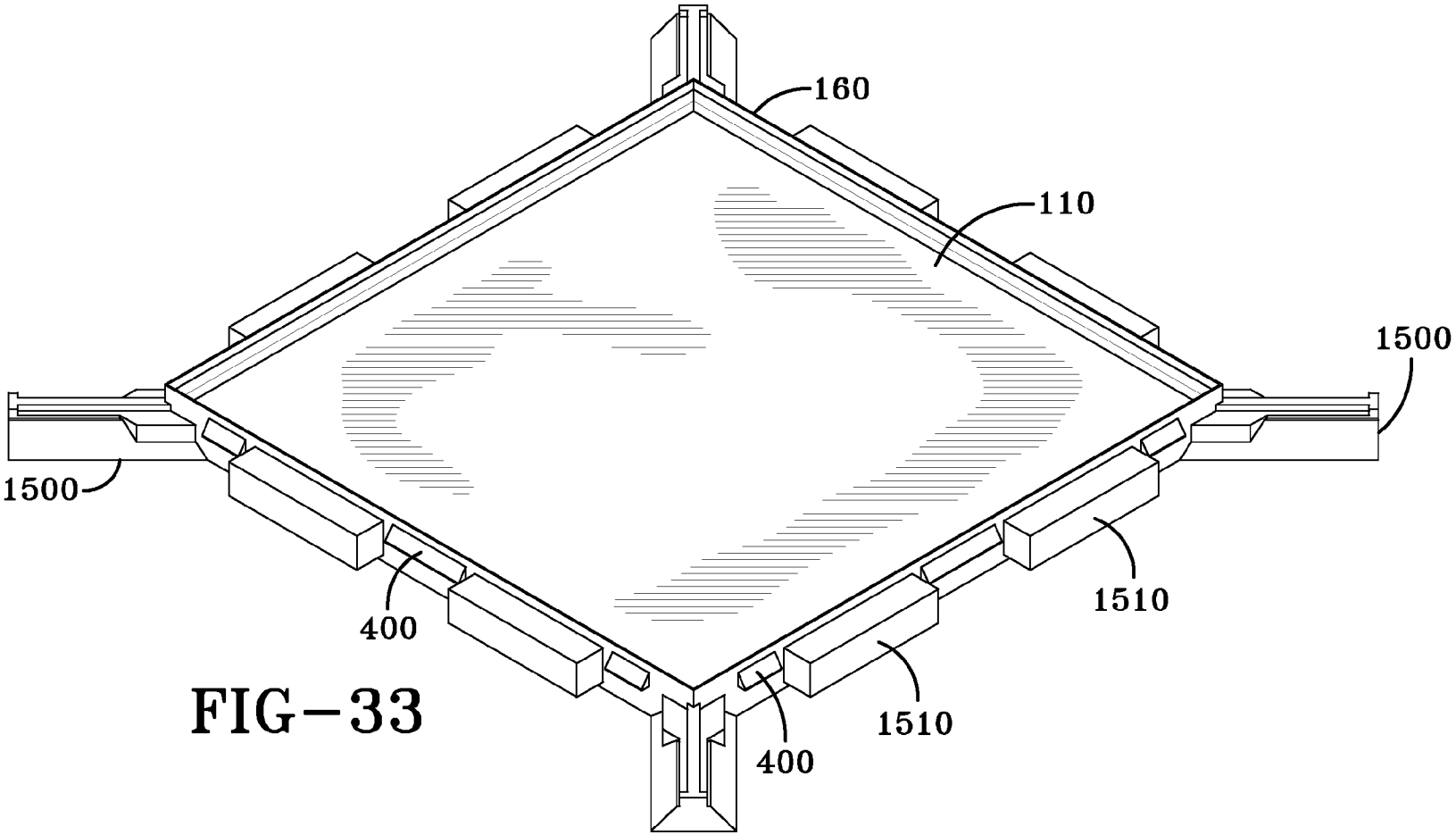
FIG. 33 shows a perspective view of an alternate embodiment with grout members.
Figure 34:
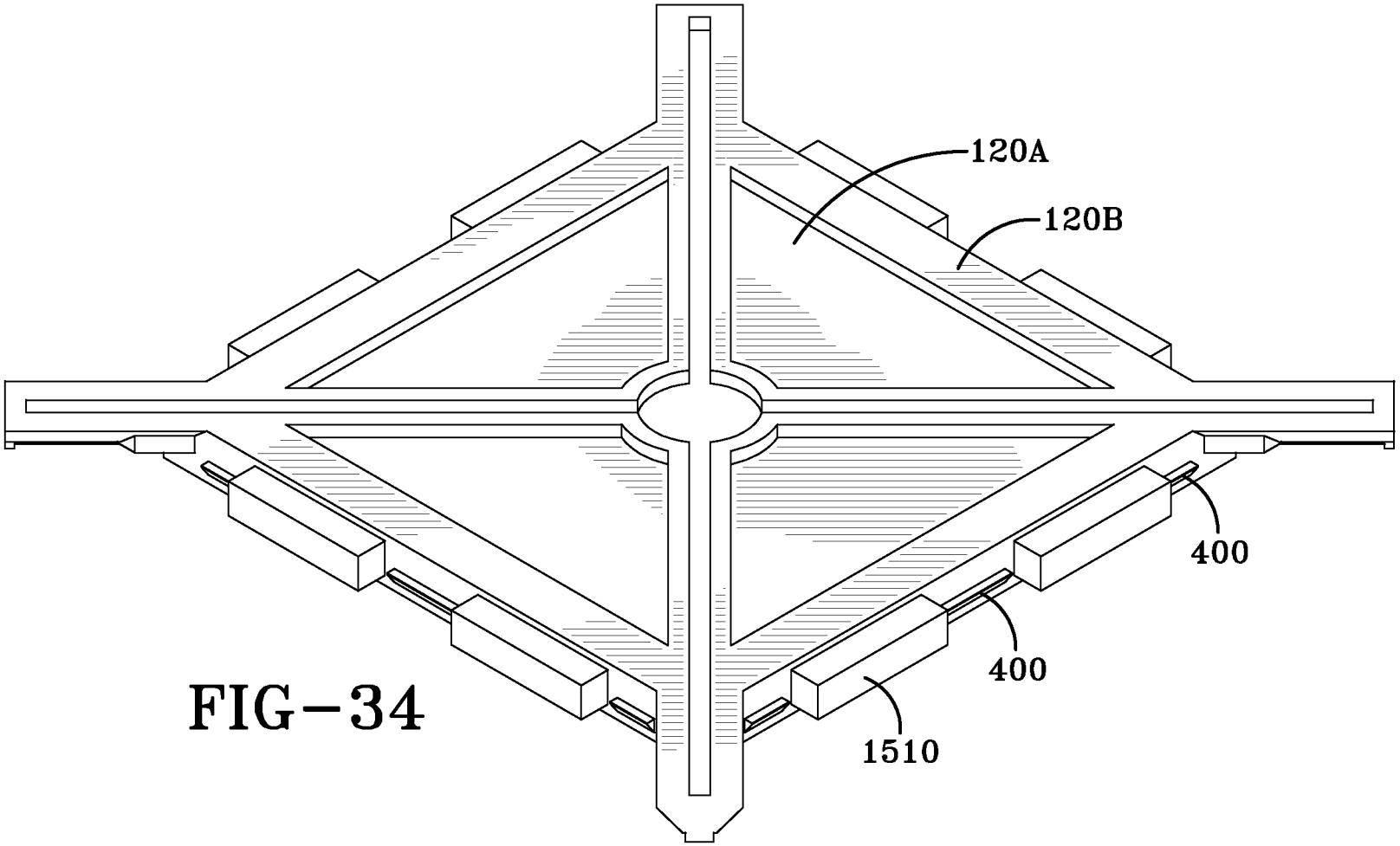
FIG. 34 shows a perspective view of the alternate embodiment viewed from the bottom.
Figure 35:
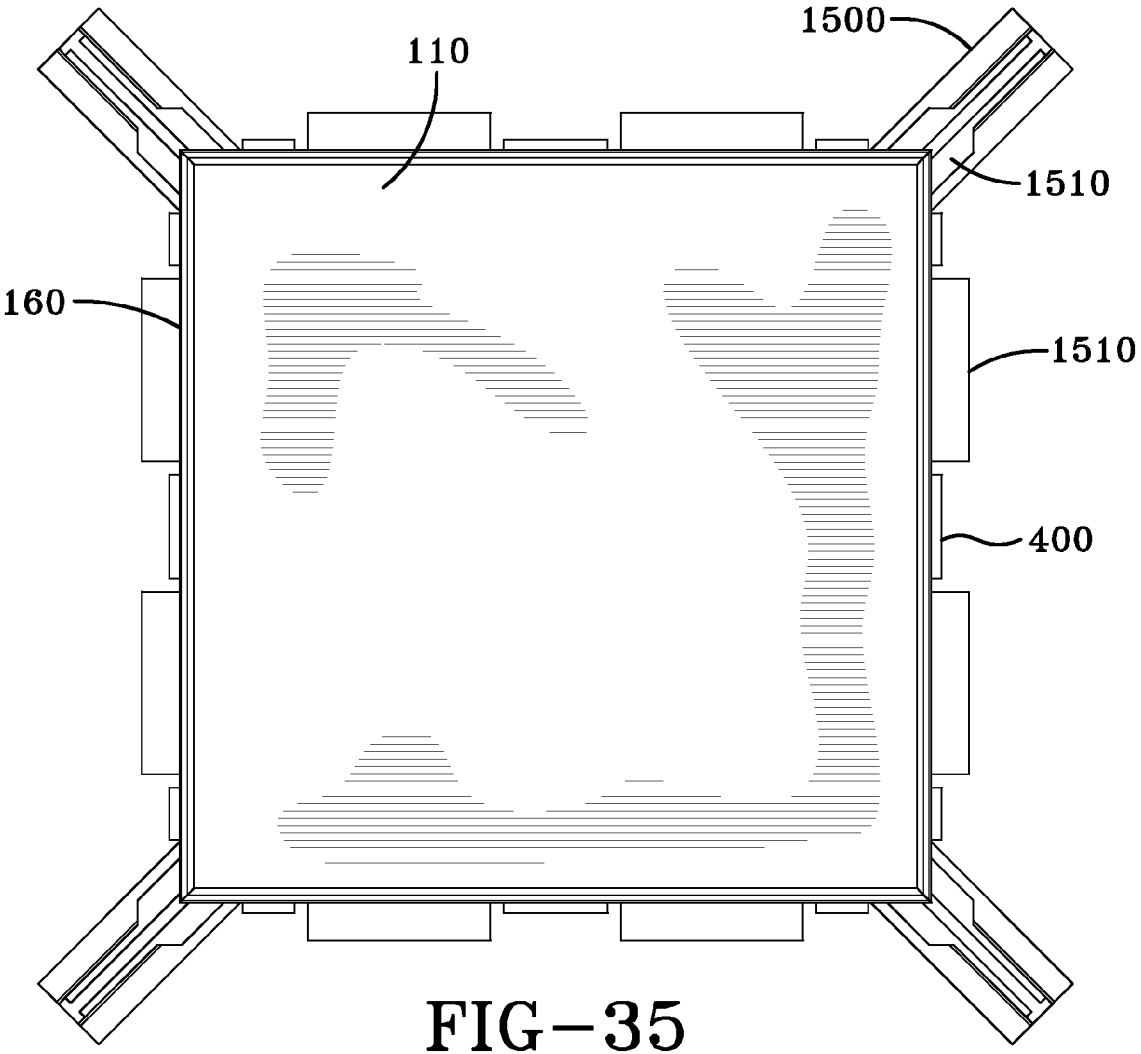
FIG. 35 shows the alternate embodiment viewed from the top.
Figure 37:
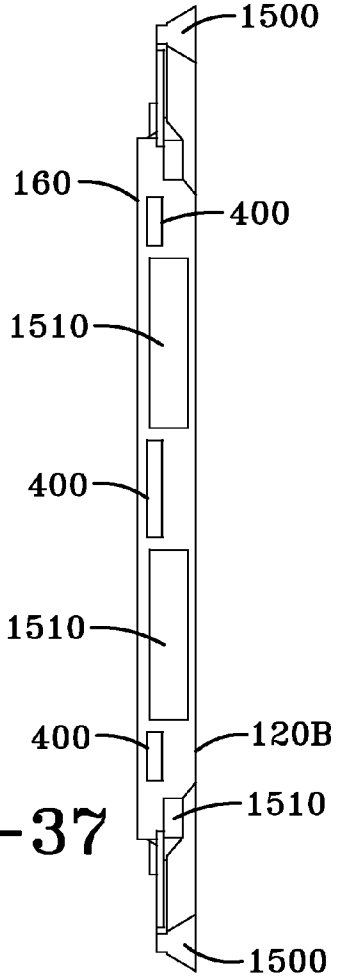
FIG. 37 is a side view of the alternate embodiment.
Figure 36:
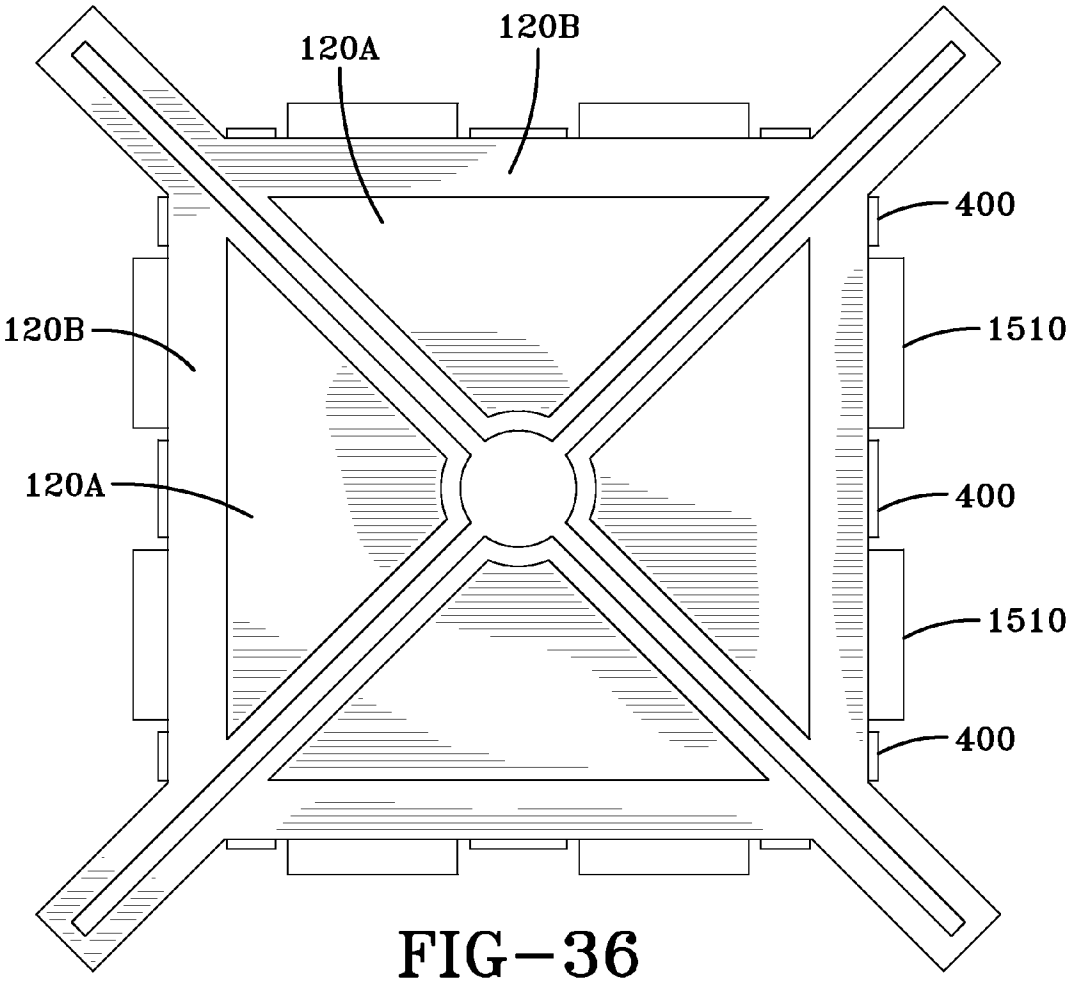
FIG. 36 shows the alternate embodiment viewed directly from the bottom.

FIG. 32 depicts the circular medallion as it is assembled as well.

FIGS. 33-37 show the various views of an alternate embodiment. In this embodiment the medallion tray substrate has grout panels 400.

Figure 38:
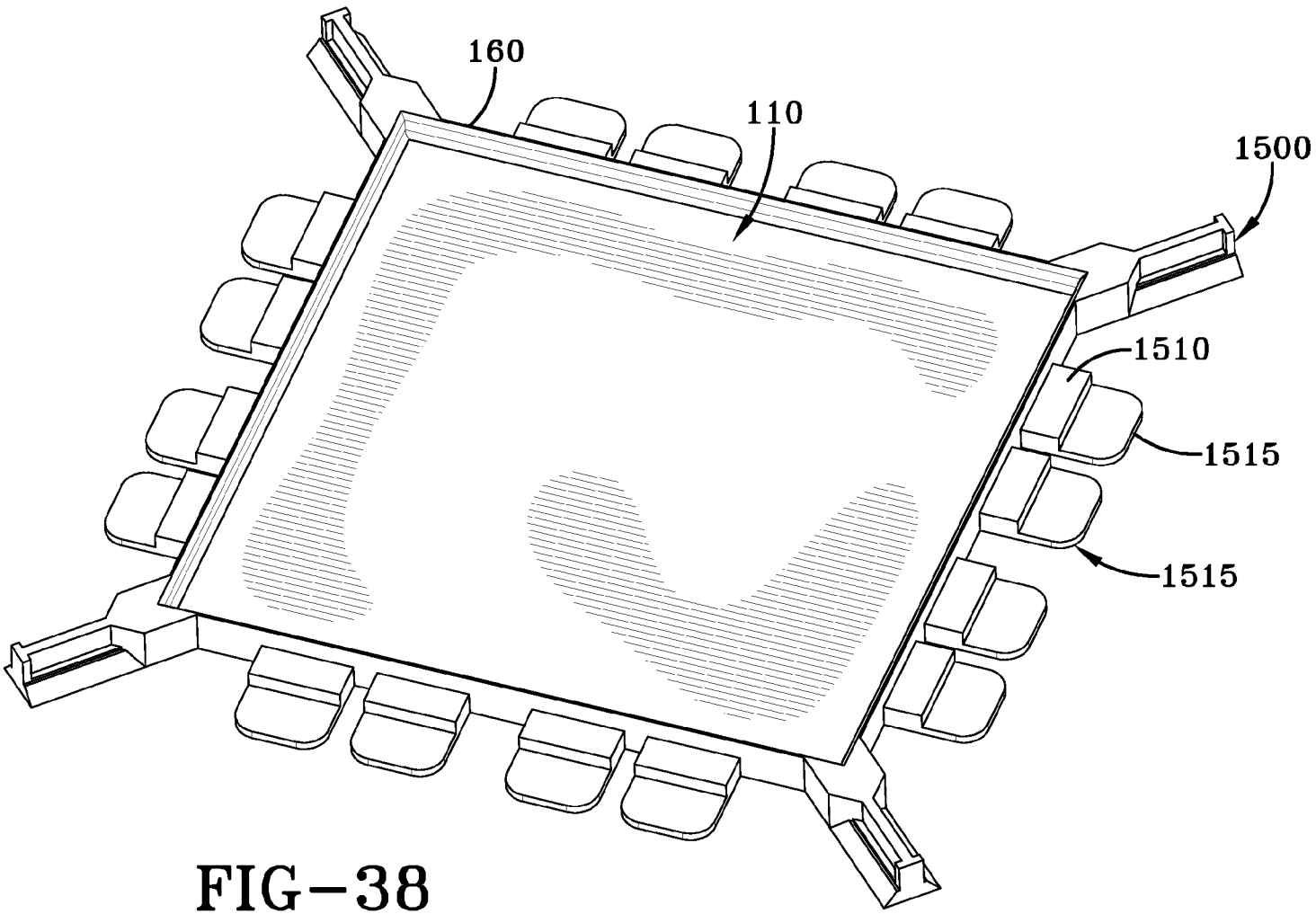
FIG. 38 is a top view of an alternate embodiment with stabilizer tabs.
Figure 39:
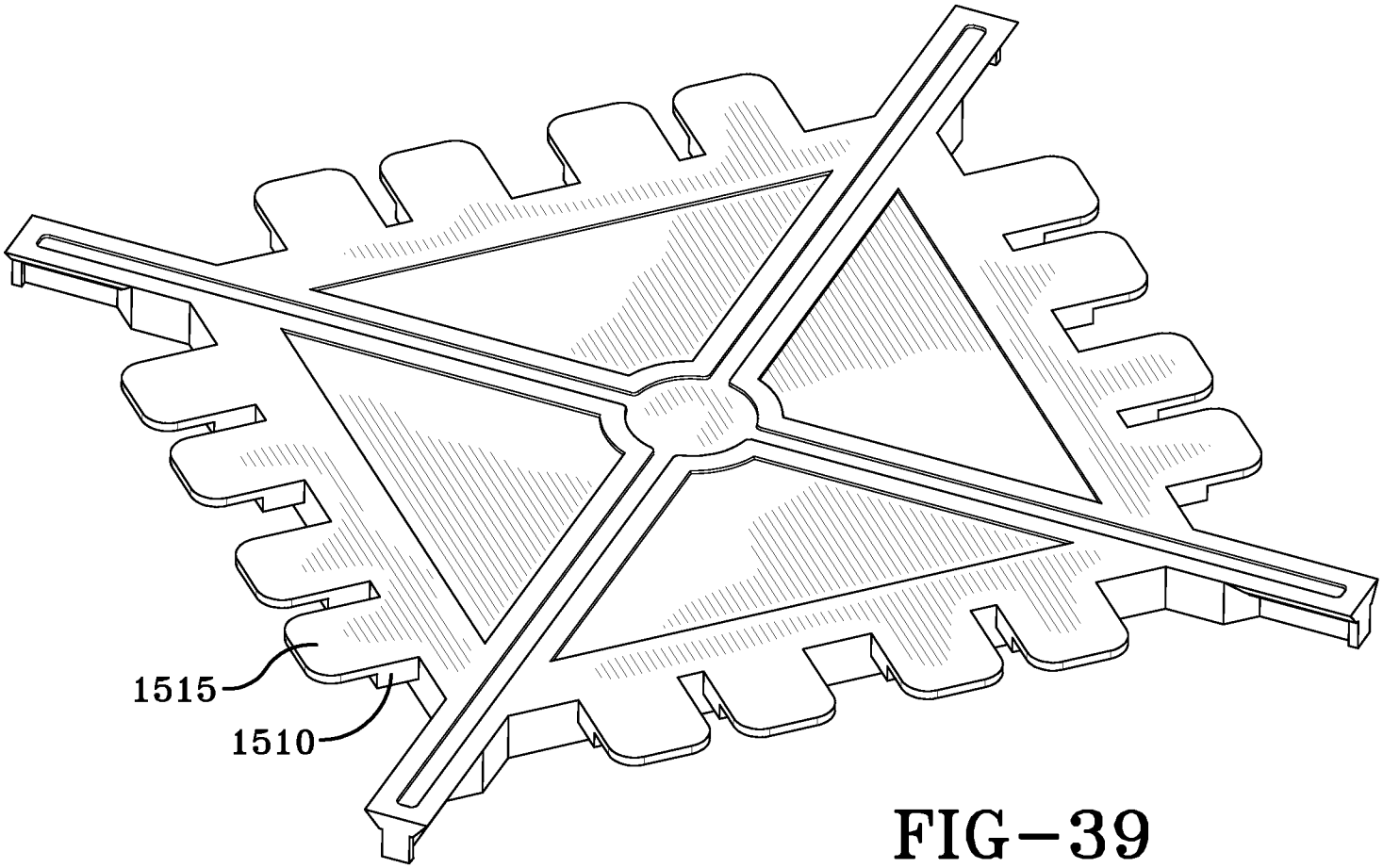
FIG. 39 is a bottom view of the alternate embodiment with stabilizer tabs.
Figure 40:
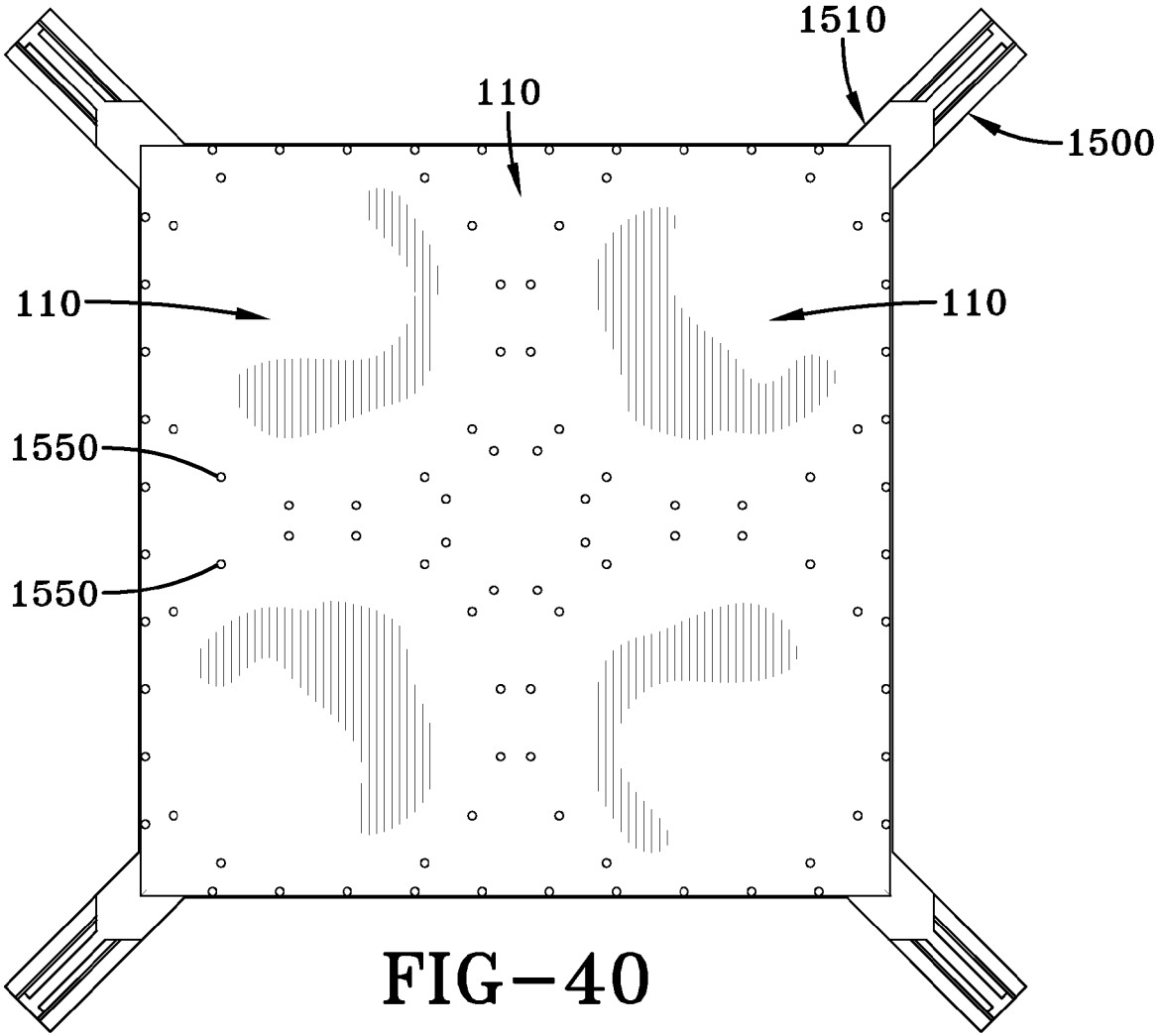
FIG. 40 is a top view of the embodiment with vertical setting pins on the tray surface.

FIGS. 38 and 39 show the various veiws of the stops with the stabilizer tabs 1515.

FIGS. 40-44 show the tray surface configuration with the vertical setting pins 1550. While these embodiments to not the vertical tray edges, the tray substrate could have the vertical tray edges. The tray surface is depicted as 110, with stops 1510 and radial arm 1500. The plurality of vertical setting pins protruding upward from the tray surface are depicted as 1550. In this example, FIG. 40, vertical setting pins are missing so that the pins present form what appears to be a circle. The missing vertical setting pins could have been removed from a tray substrate with a larger number of pins, or the tray substrate could have been manufactured in this manner.

Figure 41:
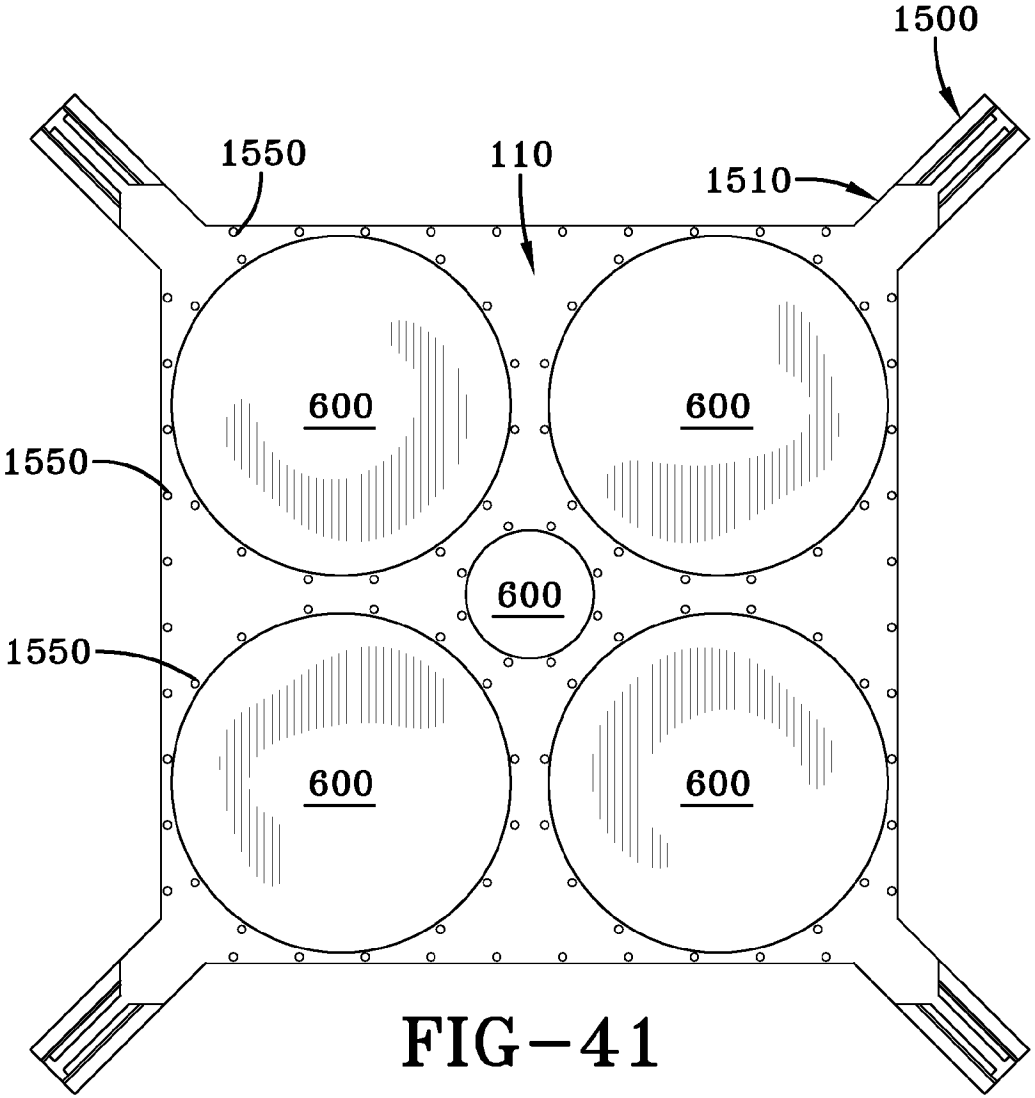
FIG. 41 is a top view of the embodiment with vertical setting pins on the tray surface with the flooring components adhered to the tray surface.
Figure 42:
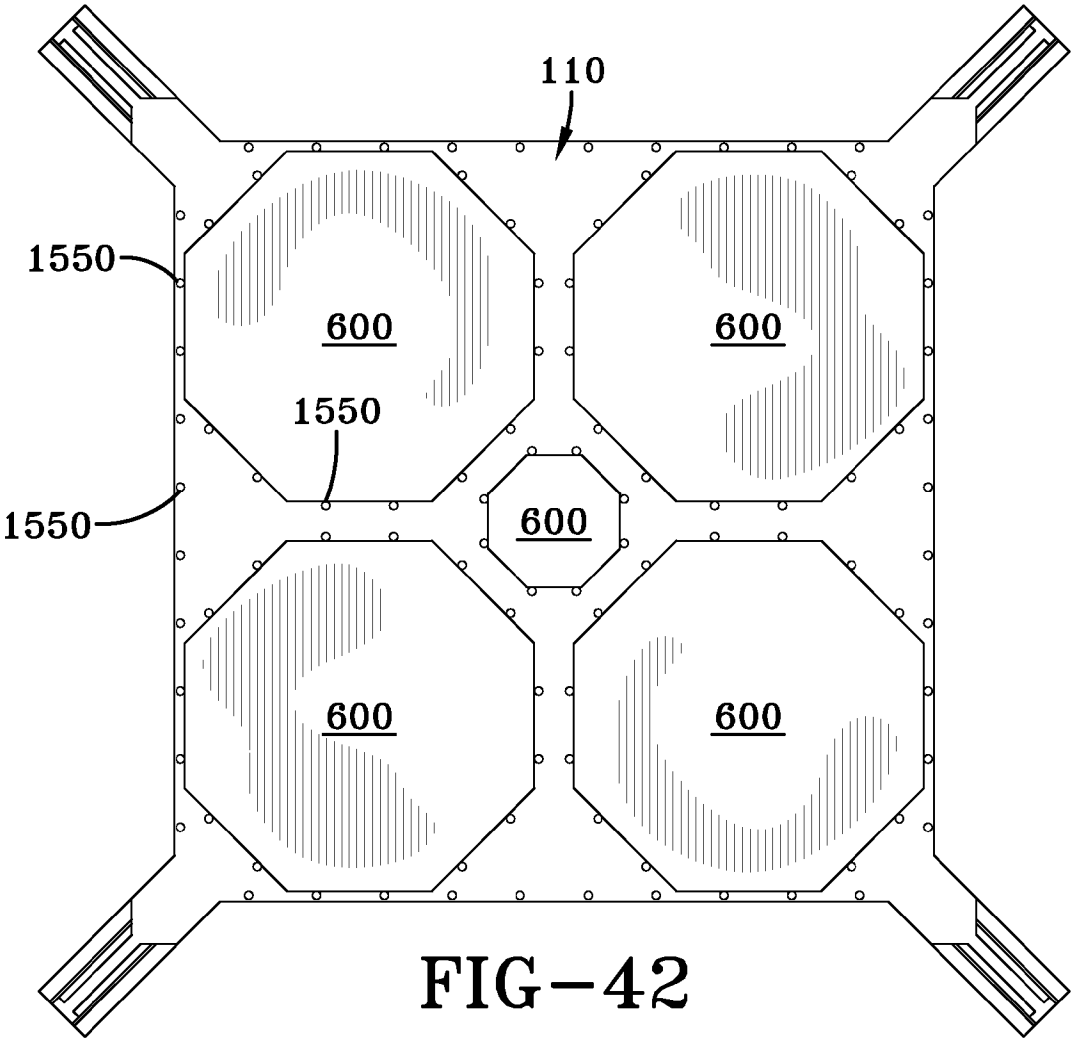
FIG. 42 is a top view of the embodiment with vertical setting pins on the tray surface showing octagon shaped flooring components.
Figure 43:
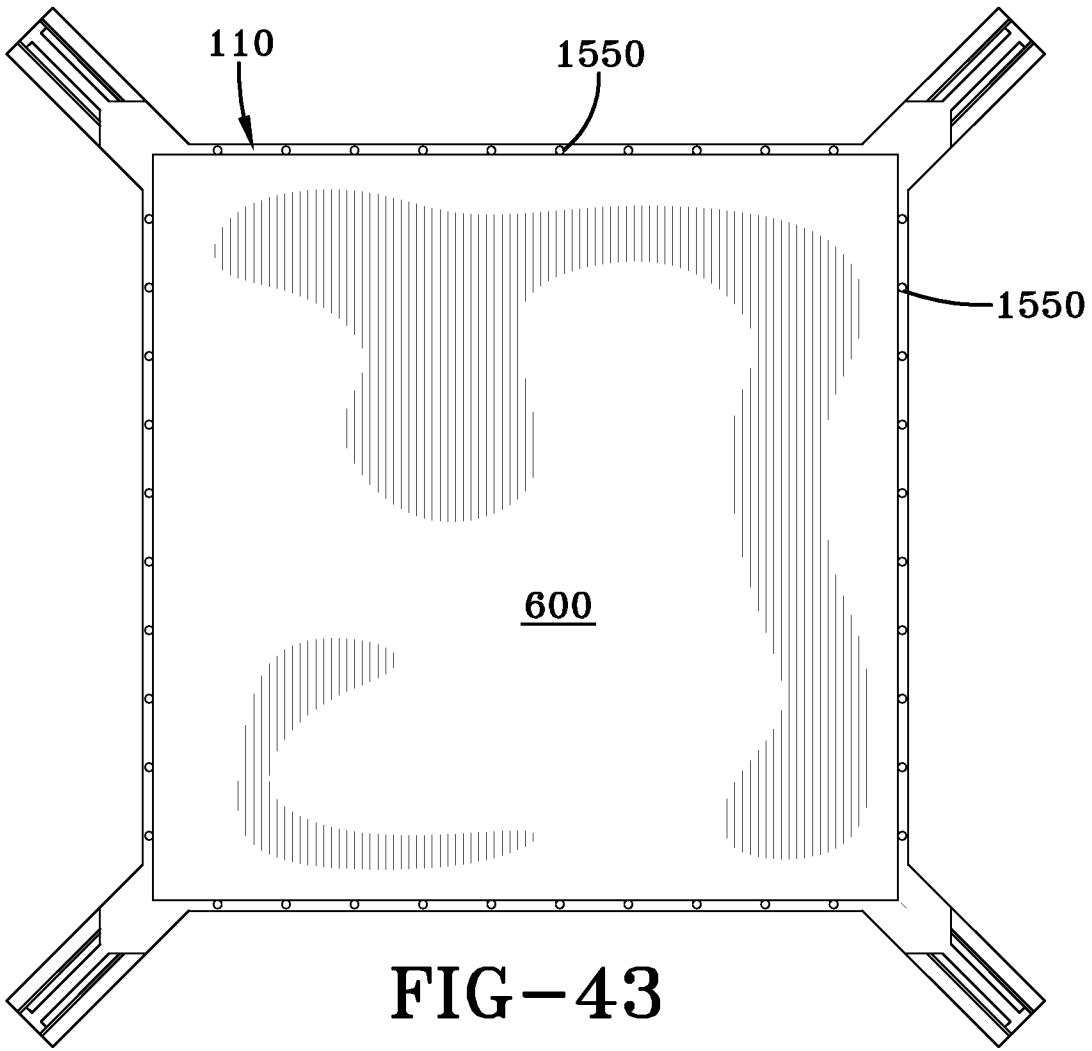
FIG. 43 is a top view of the embodiment with vertical setting pins on the tray surface holding the single square flooring component.
Figure 44:
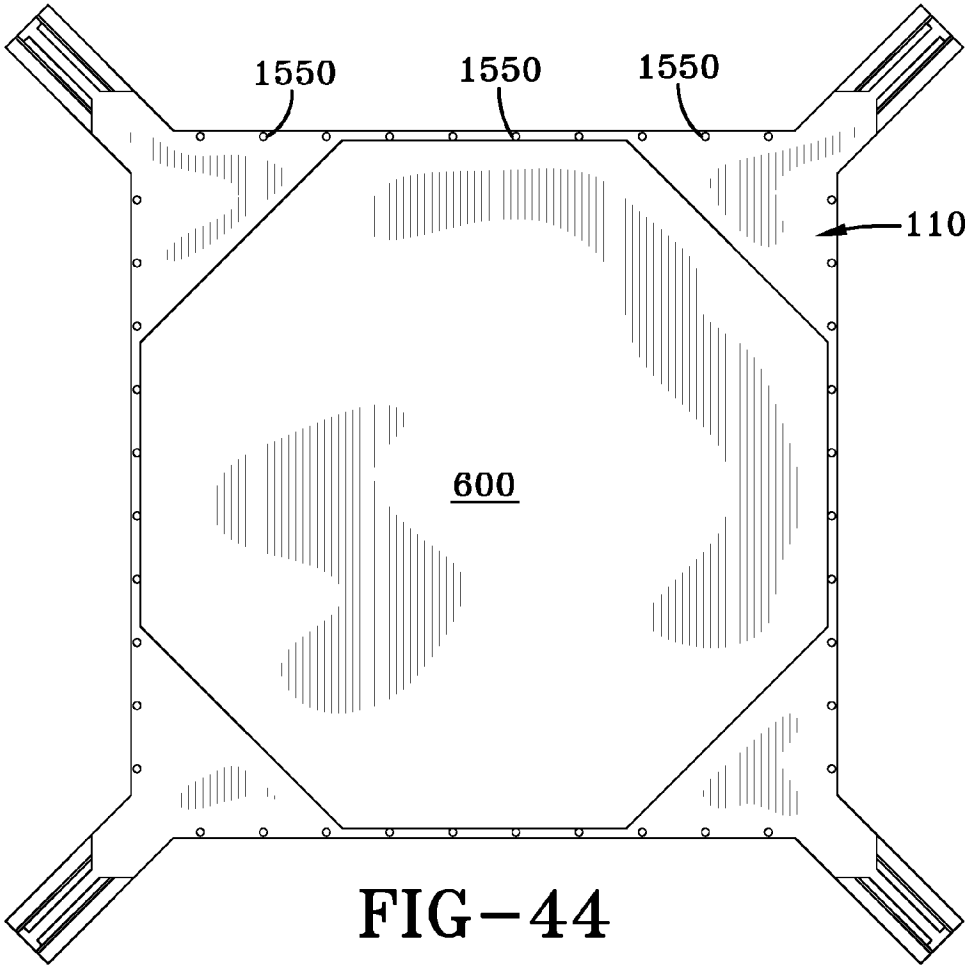
FIG. 44 is a top view of the embodiment with vertical setting pins on the tray surface with an octagon shaped flooring component.

FIG. 41 shows the four circular flooring components 600 placed within the vertical setting pins 1550. FIG. 42 shows the apparently circular pattern formed by the vertical setting pins, but the flooring components 600 are now octagonal. This demonstrates how the same tray substrate can be used to mount two different shaped flooring components. The concept is demonstrated further in FIG. 43, which places a single square flooring component 600 into the tray substrate with the vertical setting pins and FIG. 44 which demonstrates that the same vertical setting pin configuration can be used to securely position an octagonal flooring component 600.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the present invention. For example, one could use the outline of the state of Texas, United States of America as the horizontal tray surface defined by the vertical tray edges, and cut out a larger trace from the master tray substrates and then align one radial arm with the master tray substrate, snap together the corresponding second master tray substrate, then the third and then the fourth, thus creating a four master tile pattern with the state of Texas medallion somewhere in the middle. By keeping the geometric center of the radial arms apart from the geometric center of the tray substrate, the center of the design of the state could then be offset from the grout lines.

We claim:

1. A component of a flooring system comprising a tray substrate comprising a tray substrate surface which is an upward facing horizontal surface having a tray substrate surface perimeter, a tray substrate bottom with a padding attached to the tray substrate bottom, a plurality of tray substrate edges defining an outside perimeter of the tray substrate, the tray substrate edges having a plurality of radial arms; each radial arm extending horizontally in a radial direction from a geometric center of the radial arms; with each radial arm having at least one adjacent radial arm and each radial arm and the adjacent radial arm are separated by a radial angle, at least two radial arms of the plurality of radial arms protrude from the tray side in the radial direction measured from the geometric center of the radial arms at least two stops located on the outside perimeter between at least one radial arm and at least one adjacent radial arm adjacent to the at least one radial arm wherein one of the at least two stops is located between the at least one radial arm and the midpoint of the outside perimeter between the at least one radial arm and the at least one adjacent radial arm adjacent to the at least one radial arm and another of the at least two stops is located between the midpoint of the outside perimeter between the at least one radial arm and the at least one adjacent radial arm adjacent to the at least one radial arm and the at least one adjacent radial arm adjacent to the at least one radial arm.

2. The component of claim 1, wherein the tray substrate further comprises a flooring component selected from the group consisting of tile, stone, marble, wood, ceramic tile, porcelain tile, glass and granite adhered to the tray surface.

3. The component of claim 2, wherein the tray substrate further comprises a plurality of tray substrate vertical tray edges which protrude upward and extend along the tray substrate surface perimeter, and said vertical tray edges optionally run the entire perimeter of the tray substrate surface.

4. The component of claim 1, wherein the radial angles between each radial arm and the adjacent radial arm are approximately the same.

5. The component of a flooring system of claim 4, wherein the tray substrate further comprises a flooring component selected from the group consisting of tile, stone, marble, wood, ceramic tile, porcelain tile, and granite adhered to the tray surface.

6. The component of claim 1, wherein at least one stop further comprises a stabilizer tab.

7. The component of claim 1, wherein the stop runs continuously between one radial arm and at least one adjacent radial arm.

8. The component of claim 7, wherein the stop further comprises at least one stabilizer tab.

9. The component of claim 1, wherein the at least one stop is part of one radial arm.

10. A component of a flooring system comprising a tray substrate comprising a tray substrate surface which is an upward facing horizontal surface having a tray substrate surface perimeter, the tray substrate surface having a plurality of vertical setting pins protruding up from the tray substrate surface a tray substrate bottom with a padding attached to the tray substrate bottom, a plurality of tray substrate edges defining an outside perimeter of the tray substrate, the tray substrate edges having a plurality of radial arms; each radial arm extending horizontally in a radial direction from a geometric center of the radial arms; with each radial arm having at least one adjacent radial arm and each radial arm and the adjacent radial arm are separated by a radial angle, at least two radial arms of the plurality of radial arms protrude from the tray side in the radial direction measured from the geometric center of the radial arms at least two stops located on the outside perimeter between at least one radial arm and at least one adjacent radial arm adjacent to the at least one radial arm.

11. The component of claim 10, wherein at least one stop further comprises a stabilizer tab.

12. The component of claim 10, wherein one of the at least two stops is located between the at least one radial arm and the midpoint of the outside perimeter between the at least one radial arm and the at least one adjacent radial arm adjacent to the at least one radial arm and another of the at least two stops is located between the midpoint of the outside perimeter between the at least one radial arm and the at least one adjacent radial arm adjacent to the at least one radial arm and the at least one adjacent radial arm adjacent to the at least one radial arm.

13. The component of claim 12, wherein at least one stop further comprises a stabilizer tab.

* * * * *